US011698176B2

(12) United States Patent
Yamaguchi et al.

(10) Patent No.: US 11,698,176 B2
(45) Date of Patent: Jul. 11, 2023

(54) ILLUMINATION DEVICE AND VEHICLE LAMP

(71) Applicant: Stanley Electric Co., Ltd., Tokyo (JP)

(72) Inventors: Yuta Yamaguchi, Tokyo (JP); Toshimitsu Watanabe, Kyoto (JP)

(73) Assignee: STANLEY ELECTRIC CO., LTD., Tokyo (JP)

( * ) Notice: Subject to any disclaimer, the term of this patent is extended or adjusted under 35 U.S.C. 154(b) by 0 days.

(21) Appl. No.: 17/794,765

(22) PCT Filed: Jan. 19, 2021

(86) PCT No.: PCT/JP2021/001647
§ 371 (c)(1),
(2) Date: Jul. 22, 2022

(87) PCT Pub. No.: WO2021/153342
PCT Pub. Date: Aug. 5, 2021

(65) Prior Publication Data

US 2023/0075945 A1 Mar. 9, 2023

(30) Foreign Application Priority Data

Jan. 30, 2020 (JP) ..... 2020-013645

(51) Int. Cl.
*F21S 41/14* (2018.01)
*F21S 41/176* (2018.01)
(Continued)

(52) U.S. Cl.
CPC ..... *F21S 41/176* (2018.01); *F21S 41/16* (2018.01); *F21S 41/25* (2018.01)

(58) Field of Classification Search
None
See application file for complete search history.

(56) References Cited

U.S. PATENT DOCUMENTS

2011/0063115 A1* 3/2011 Kishimoto ..... F21K 9/00 250/206
2015/0369440 A1 12/2015 Reinprecht et al.
(Continued)

FOREIGN PATENT DOCUMENTS

JP 2016-507135 A 3/2016
JP 2016-134357 A 7/2016
(Continued)

OTHER PUBLICATIONS

International Search Report and Written Opinion of the International Search Report for PCT/JP2021/001647 dated Mar. 23, 2021.

*Primary Examiner* — Elmito Breval
(74) *Attorney, Agent, or Firm* — Kenealy Vaidya LLP

(57) ABSTRACT

In an illumination device, an incidence angle of a laser beam, which is scanned by a laser beam scanning mechanism, with respect to a wavelength conversion member is set to an angle where the laser beam does not directly enter a projection lens when the wavelength conversion member is damaged, chipped or fallen off, and a laser light source and the laser beam scanning mechanism are located at a position corresponding to at least one of an upper side and a lower side of a light distribution pattern with respect to the wavelength conversion member, and are disposed to be deviated to either one of one side corresponding to a left side of the light distribution pattern and other side corresponding to a right side of the light distribution pattern.

10 Claims, 20 Drawing Sheets

(51) Int. Cl.
*F21S 41/25* (2018.01)
*F21S 41/16* (2018.01)

(56) References Cited

U.S. PATENT DOCUMENTS

| | | | | |
|---|---|---|---|---|
| 2016/0010821 | A1* | 1/2016 | Ahn ..... | F21S 41/16<br>362/510 |
| 2016/0153632 | A1 | 6/2016 | Mitterlehner | |
| 2016/0215947 | A1 | 7/2016 | Matsuno | |
| 2019/0390831 | A1 | 12/2019 | Yamaguchi | |

FOREIGN PATENT DOCUMENTS

| | | | |
|---|---|---|---|
| JP | 2016-528671 | A | 9/2016 |
| JP | 2017-191760 | A | 10/2017 |
| JP | 6312484 | B2 | 4/2018 |
| JP | 2018-106825 | A | 7/2018 |
| JP | 2019-220605 | A | 12/2019 |
| JP | 2020-004517 | A | 1/2020 |
| WO | 2021/153342 | A1 | 8/2021 |

* cited by examiner

ILLUMINATION DEVICE AND VEHICLE LAMP

This application is a U.S. National Stage Application under 35 U.S.C § 371 of International Patent Application No. PCT/JP2021/001647 filed Jan. 19, 2021, which claims the benefit of priority to Japanese Patent Application No. 2020-013645 filed Jan. 30, 2020, the disclosures of all of which are hereby incorporated by reference in their entireties.

TECHNICAL FIELD

The present invention relates to an illumination device, and a vehicle lamp including such an illumination device.

Priority is claimed on Japanese Patent Application No. 2020-013645, filed Jan. 30, 2020, the content of which is incorporated herein by reference.

BACKGROUND ART

In recent years, illumination light has been obtained by irradiating a phosphor plate (a wavelength conversion member) with a laser beam emitted from a laser light source such as a laser diode (LD) or the like, by which high brightness and high output light is obtained.

In such an illumination device, by combining a laser light source configured to emit a blue laser beam and a phosphor plate configured to emit wavelength converted yellow light (fluorescent light) excited by the blue laser beam (exciting light), white light (illumination light) can be obtained through color mixing of this blue light and yellow light.

In addition, a vehicle lamp to which such an illumination device is applied is known. In the vehicle lamp, the illumination device is used in a headlight (headlamp) for a vehicle configured to project illumination light that forms a light distribution pattern for a low beam including a cutoff line on an upper end thereof as a passing beam (low beam) and illumination light that forms a light distribution pattern for a high beam above the light distribution pattern for the low beam as a traveling beam (high beam) toward a side in front of the vehicle using a projection lens.

Specifically, in the vehicle lamp, the light distribution pattern according to a scanning range of a laser beam is formed by providing a laser beam irradiation region corresponding to each of the light distribution pattern of each of the light distribution pattern for a low beam, a light distribution pattern for a high beam, and the like, which are above-mentioned, in a surface of a phosphor plate, and by scanning the laser beam radiated to the laser beam irradiation region using a laser beam scanning mechanism such as a micro-electro-mechanical systems (MEMS) mirror or the like (for example, see Patent Literature 1).

Further, in such a vehicle lamp, it is also possible to provide a light distribution variable headlamp (adaptive driving beam (ADB)) configured to variably control a light distribution pattern of light projected toward a side in front of the vehicle through scanning of the laser beam. The ADB is a technology of recognizing a preceding car, an oncoming car, a pedestrian, or the like using an in-vehicle camera, and enlarging a visual field in front of a driver at nighttime without imparting glare to a driver or a pedestrian in front of the driver.

CITATION LIST

Patent Literature

[Patent Literature 1]
Japanese Patent No. 6312484

SUMMARY OF INVENTION

Technical Problem

Incidentally, in the above-mentioned illumination device, a laser beam with high light intensity scans a surface of the phosphor plate. In addition, the laser beam radiated on the phosphor plate is diffused by phosphor particles dispersed in the phosphor plate. For this reason, since the light intensity per unit area of the light emitted from the phosphor plate becomes low and becomes non-coherent light, it becomes illumination light that is safe for the eyes.

Meanwhile, a temperature distribution in the surface of the phosphor plate is generated through scanning of the laser beam. In addition, in the case of the vehicle lamp, since it is exposed to external air, it is also affected by an external air temperature. The vehicle lamp may undergo, for example, a temperature change from −40° C. to over +100° C.

Accordingly, a mechanical external force such as distortion or the like due to a temperature change is applied to the phosphor plate. In addition, in the case of the vehicle lamp, an external force such as vibration, an impact, or the like from the vehicle is applied to the phosphor plate. Due to the influence of these external forces, not only damages or defects such as breaks, chips, cracks, pinholes, or the like, may occur in the phosphor plate, but there is a possibility that the phosphor plate may also fall out.

When damage, defects, or falling off occurs in the phosphor plate, the laser beam may be emitted directly to the outside through the projection lens. In this case, since it is dangerous if the laser beam enters the human eye directly, a mechanism configured to detect falling off of the phosphor plate is provided, and the laser light source is turned off (OFF) when the phosphor plate is falling off.

However, in the mechanism configured to detect falling of the phosphor plate, it is impossible to detect flaws or damage such as minute cracks, pinholes, or the like generated in the phosphor plate. For this reason, the laser beam may be emitted directly to the outside through the projection lens.

An aspect of the present invention provides an illumination device that prevents a laser beam from being emitted directly to the outside through a projection lens even when flaws, damage, or falling off occurs in a wavelength conversion member, and a vehicle lamp including such an illumination device.

Solution to Problem

An aspect of the present invention provides the following configurations.

(1) An illumination device including:

a laser light source configured to emit a laser beam;

a wavelength conversion member that includes a laser beam irradiation region to which the laser beam is radiated and that is configured to emit a wavelength converted light excited by radiation of the laser beam;

a laser beam scanning mechanism configured to form a light distribution pattern according to a scanning range of the laser beam by scanning the laser beam radiated to the laser beam irradiation region; and a projection lens configured to project illumination light that forms the light distribution pattern forward, wherein an incidence angle of the laser beam, which is scanned by the laser beam scanning mechanism, with respect to the wavelength conversion member is set to an angle where the laser beam does not directly enter the projection lens when the wavelength conversion member is damaged, chipped or fallen off, and the laser light source and the laser beam scanning mechanism are located at a position corresponding to at least one of an upper side and a lower side of the light distribution pattern with respect to the wavelength conversion member, and are disposed to be deviated to either one of one side corresponding to a left side of the light distribution pattern and other side corresponding to a right side of the light distribution pattern.

(2) The illumination device according to the above-mentioned (1), wherein, when the wavelength conversion member is seen in a plan view, a center of the scanning range of the laser beam is located at an intersection between a vertical line corresponding to an upward/downward direction of the light distribution pattern passing through a center of the laser beam scanning mechanism and a horizontal line corresponding to a leftward/rightward direction of the light distribution pattern passing through a center of the laser beam irradiation region.

(3) The illumination device according to the above-mentioned (1) or (2), wherein the laser light source and the laser beam scanning mechanism are disposed on one side corresponding to the left side of the light distribution pattern and other side corresponding to the right side of the light distribution pattern, respectively, the laser beam scanning mechanism disposed on the one side forms a light distribution pattern according to a scanning range of one laser beam by scanning the one laser beam radiated toward the laser beam irradiation region from the laser light source disposed on the one side, the laser beam scanning mechanism disposed on the other side forms a light distribution pattern according to a scanning range of other laser beam by scanning the other laser beam radiated toward the laser beam irradiation region from the laser light source disposed on the other side, and one synthesis light distribution pattern is formed by overlapping the light distribution pattern according to the scanning range of the one laser beam and the light distribution pattern according to the scanning range of the other laser beam.

(4) The illumination device according to the above-mentioned (3), wherein, when the wavelength conversion member is seen in a plan view, each of the center of the scanning range of the one laser beam and the center of the scanning range of the other laser beam is located at intersections between the vertical lines corresponding to the upward/downward direction of the light distribution patterns passing through the centers of the laser beam scanning mechanisms and the horizontal lines corresponding to the leftward/rightward direction of the light distribution patterns passing through the centers of the laser beam irradiation regions, respectively.

(5) The illumination device according to any one of the above-mentioned (1) to (4), wherein the laser light source and the laser beam scanning mechanism are additionally disposed at positions corresponding to an upper side or a lower side of the light distribution pattern with respect to the wavelength conversion member, or disposed at positions corresponding an upper side and a lower side of the light distribution pattern with respect to the wavelength conversion member, and at between the one side and the other side, the laser beam scanning mechanism disposed on an additional side forms a light distribution pattern according to a scanning range of an added laser beam radiated toward the laser beam irradiation region from the laser light source disposed on the additional side by scanning an additional laser beam, and one synthesis light distribution pattern is formed by overlapping the light distribution pattern according to the scanning range of the one laser beam, the light distribution pattern according to the scanning range of the other laser beam, and the light distribution pattern according to the scanning range of the added laser beam.

(6) The illumination device according to the above-mentioned (5), wherein, when the wavelength conversion member is seen in a plan view, a center of a scanning range of the added laser beam is located at an intersection between at vertical line corresponding to the upward/downward direction of the light distribution pattern passing through a center of the laser beam scanning mechanism on the additional side and a horizontal line corresponding to the leftward/rightward direction of the light distribution pattern which passes through the center of the laser beam irradiation region.

(7) The illumination device according to any one of the above-mentioned (1) to (4), wherein the laser light source and the laser beam scanning mechanism are additionally disposed on the left side or the right side of the light distribution pattern with respect to the wavelength conversion member, or disposed at positions corresponding to the left side and the right side of the light distribution pattern with respect to the wavelength conversion member, the laser beam scanning mechanism disposed on an additional side forms a light distribution pattern according to a scanning range of an added laser beam radiated toward the laser beam irradiation region from the laser light source disposed on the additional side by scanning the added laser beam, and one synthesis light distribution pattern is formed by overlapping the light distribution pattern according to the scanning range of the one laser beam, the light distribution pattern according to the scanning range of the other laser beam, and the light distribution pattern according to the scanning range of the added laser beam.

(8) The illumination device according to the above-mentioned (7), wherein, when the wavelength conversion member is seen in a plan view, the center of the scanning range of the added laser beam is located at a side opposite to a side in which the laser beam scanning mechanism disposed on the additional side is disposed with respect to the center of the laser beam irradiation region.

(9) The illumination device according to any one of the above-mentioned (1) to (8), wherein, when the wavelength conversion member is seen in a plan view, a width of the laser beam irradiation region, which corresponds to a leftward/rightward direction of the light distribution pattern, is greater than a height of the laser beam irradiation region, which corresponds to an upward/downward direction of the light distribution pattern.

(10) A vehicle lamp comprising the illumination device according to any one of the above-mentioned (1) to (9).

Advantageous Effects of Invention

According to the aspect of the present invention, it is possible to provide an illumination device that prevents a laser beam from being emitted directly to the outside through a projection lens even when flaws, damage, or falling off occurs in a wavelength conversion member, and a vehicle lamp including such an illumination device.

DESCRIPTION OF EMBODIMENTS

Figure 1:
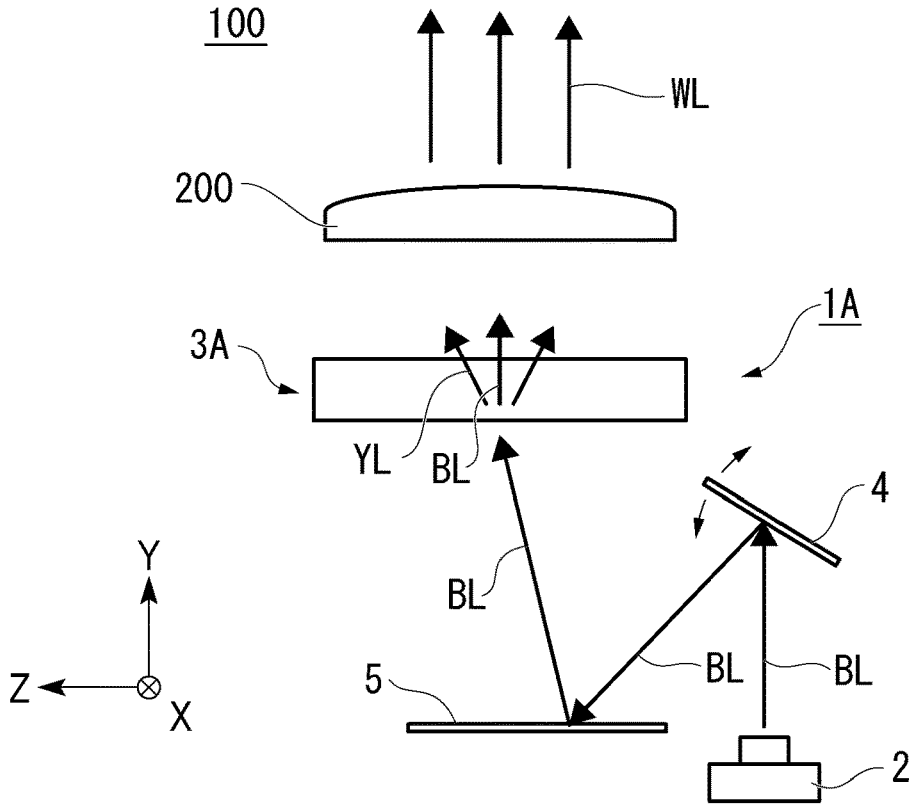
FIG. 1 is a schematic diagram showing a configuration of a vehicle lamp including a transmission type illumination device according to a first embodiment of the present invention.

Hereinafter, embodiments of the present invention will be described with reference to the accompanying drawings.

Further, in the drawings used in the following description, in order to make components easier to see, scales of dimensions may be shown differently depending on the components, and dimensional ratios of each of the components may not be the same as the actual ones.

First Embodiment

First, a vehicle lamp 100 including illumination devices 1A and 1B according to a first embodiment of the present invention will be described with reference to FIG. 1 and FIG. 2.

Further, FIG. 1 is a schematic diagram showing a configuration of the vehicle lamp 100 including the transmission type illumination device 1A. FIG. 2 is a schematic diagram showing a configuration of the vehicle lamp 100 including the reflection type illumination device 1B.

In addition, in the drawings described below, an XYZ orthogonal coordinate system is set, wherein an X-axis direction represents a forward/rearward direction in the illumination devices 1A and 1B (the vehicle lamp 100), a Y-axis direction represents a leftward/rightward direction of the illumination devices 1A and 1B (the vehicle lamp 100), and a Z-axis direction represents an upward/downward direction of the illumination devices 1A and 1B (the vehicle lamp 100).

(Transmission Type Illumination Device)

As shown in FIG. 1, for example, the illumination device 1A of the embodiment is obtained by applying the present invention to a headlight (headlamp) for a vehicle configured to radiate illumination light W toward a side in front of the vehicle (a +X-axis direction) as the vehicle lamp 100 mounted on the vehicle.

Further, in the following description, directions of "forward," "rearward," "leftward," "rightward," "upward" and "downward" are not limiting unless the context clearly indicates otherwise, and indicate directions when the front surface of the vehicle lamp 100 is viewed (from in front of the vehicle).

The illumination device 1A constitutes the vehicle lamp 100 including a projection lens 200 configured to project the illumination light WL to a side in front of the vehicle by being accommodated in a lighting body (not shown) together with the projection lens 200.

Specifically, the illumination device 1A generally includes a laser light source 2 configured to emit a laser beam BL that is exciting light, a transmission type wavelength conversion member 3A configured to emit wavelength converted fluorescent light YL excited by radiation of the laser beam BL, a laser beam scanning mechanism 4 configured to scan the laser beam BL radiated toward the wavelength conversion member 3A, and a reflector 5 configured to reflect the laser beam BL scanned by the laser beam scanning mechanism 4 toward the wavelength conversion member 3A.

The laser light source 2 is constituted by a laser diode (LD) configured to emit, for example, a blue laser beam (an emission wavelength is about 450 nm) as the laser beam BL. Further, the laser light source 2 may use the LD configured to emit an ultraviolet laser beam as the laser beam BL.

The wavelength conversion member 3A is constituted by a phosphor plate containing yellow phosphor particles excited by radiation of the laser beam BL to emit yellow light as the fluorescent light YL. In the embodiment, a member containing phosphor particles constituted by a composite (sintered compact) of YAG, into which an activator such as cerium Ce or the like is introduced, and alumina $Al_2O_3$, is used as the wavelength conversion member 3A. Further, the wavelength conversion member 3A may have a configuration in which a diffusing agent is contained in order to control light distribution characteristics of the illumination light WL emitted from the illumination device 1A, in addition to the phosphor particles.

The laser beam scanning mechanism 4 is constituted by a MEMS mirror disposed on an optical path between the laser light source 2 and the wavelength conversion member 3A. The MEMS mirror is a movable mirror using a MEMS technology, and controls a scanning direction and a scanning speed of the laser beam BL scanning the surface of the wavelength conversion member 3A.

The reflector 5 is constituted by a planar mirror disposed on an optical path between the wavelength conversion member 3A and the laser beam scanning mechanism 4. The reflector 5 reflects the laser beam BL reflected by the MEMS mirror toward a back surface of the wavelength conversion member 3A.

In the illumination device 1A of the embodiment, the laser beam (blue light) BL radiated toward the back surface of the wavelength conversion member 3A passes through the wavelength conversion member 3A while being partially diffused therein, and the phosphor particles in the wavelength conversion member 3A are excited by radiation of the laser beam BL, and fluorescent light (yellow light) YL is emitted, and thereby, illumination light (white light) WL can be emitted toward the projection lens 200 on the side in front due to color mixing of this blue light and yellow light.

(Reflection Type Illumination Device)

Figure 2:
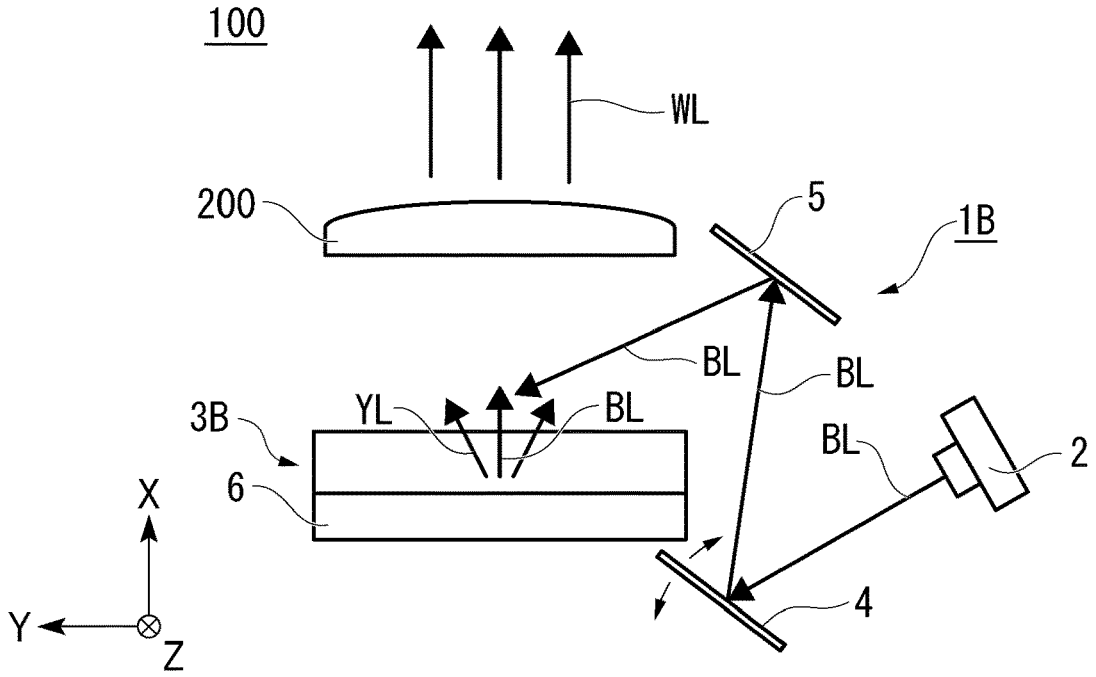
FIG. 2 is a schematic diagram showing a configuration of the vehicle lamp including a reflection type illumination device according to the first embodiment of the present invention.

Meanwhile, as shown in FIG. 2, like the illumination device 1A, for example, the illumination device 1B of the embodiment is obtained by applying the present invention to a headlight (headlamp) for a vehicle configured to radiate the illumination light W toward a side in front of the vehicle (a +X-axis direction) as the vehicle lamp 100 mounted on the vehicle.

The illumination device 1B constitutes the vehicle lamp 100 by being accommodated in the lighting body (not shown) together with the projection lens 200 configured to project the illumination light WL toward a side in front of the vehicle.

Specifically, the illumination device 1B generally includes a laser light source 2 configured to emit a laser beam BL that is exciting light, a reflection type wavelength conversion member 3B configured to emit the wavelength converted fluorescent light YL excited by radiation of the laser beam BL, a laser beam scanning mechanism 4 configured to scan the laser beam BL radiated toward a wavelength conversion member 3B, and a reflector 5 configured to reflect the laser beam BL scanned by the laser beam scanning mechanism 4 toward the wavelength conversion member 3B.

That is, the illumination device 1B includes the reflection type wavelength conversion member 3B, instead of the transmission type wavelength conversion member 3A, and has basically the same configuration as the illumination device 1A except that disposition of the laser light source 2, the laser beam scanning mechanism 4 and the reflector 5 is changed according to disposition of the wavelength conversion member 3B.

The wavelength conversion member 3B has a configuration in which a reflection plate 6 is disposed on the side of the back surface of the phosphor plate that constitutes the wavelength conversion member 3A. The reflection plate 6 reflects the laser beam BL entering from the side of a front surface of the wavelength conversion member 3B and the fluorescent light YL excited in the wavelength conversion member 3B toward the front surface of the wavelength conversion member 3B.

In the illumination device 1B of the embodiment, the laser beam (blue light) BL radiated toward the front surface of the wavelength conversion member 3B can be reflected by the wavelength conversion member 3B while being partially diffused, and the illumination light (white light) WL can be emitted toward the projection lens 200 on the front side by color mixing of this blue light and yellow light while emitting fluorescent light (yellow light) YL as yellow phosphor particles in the wavelength conversion member 3A are excited by radiation of the laser beam BL.

(Vehicle Lamp)

In the vehicle lamp 100 of the embodiment, by providing the above-mentioned illumination devices 1A and 1B, the illumination light WL that forms a light distribution pattern for a low beam including a cutoff line on an upper end as a passing beam (low beam) or the illumination light WL that forms a light distribution pattern for a high beam above the light distribution pattern for a low beam as a traveling beam (high beam) can be projected toward a side in front of the vehicle by the projection lens 200.

In addition, the vehicle lamp 100 of the embodiment may be a light distribution variable headlamp (ADB) configured to variably control a light distribution pattern of the illumination light WL projected toward the side in front of the vehicle through scanning of the laser beam BL.

Further, in the vehicle lamp 100 of the embodiment, in order to improve safety in driving, it is also possible for the projection lens 200 to project drawing light that forms an image (a light distribution pattern for drawing) toward a road surface through scanning of the laser beam BL separately from the illumination light WL projected toward the side in front of the vehicle.

In the illumination devices 1A and 1B of the embodiment having the above-mentioned configuration, an incidence angle of the laser beam BL, which is scanned by the above-mentioned laser beam scanning mechanism 4, with respect to the wavelength conversion members 3A and 3B is set to an angle at which the laser beam BL does not directly enter the projection lens 200 when the wavelength conversion members 3A and 3B are damaged, chipped or fallen off Accordingly, in the vehicle lamp 100 including the illumination devices 1A and 1B of the embodiment, even when flaws, damage, falling off, or the like occurs in the wavelength conversion members 3A and 3B, it is possible to prevent the laser beam BL, which is scanned by the laser beam scanning mechanism 4, from being emitted directly to the outside through the projection lens 200.

Figure 3:
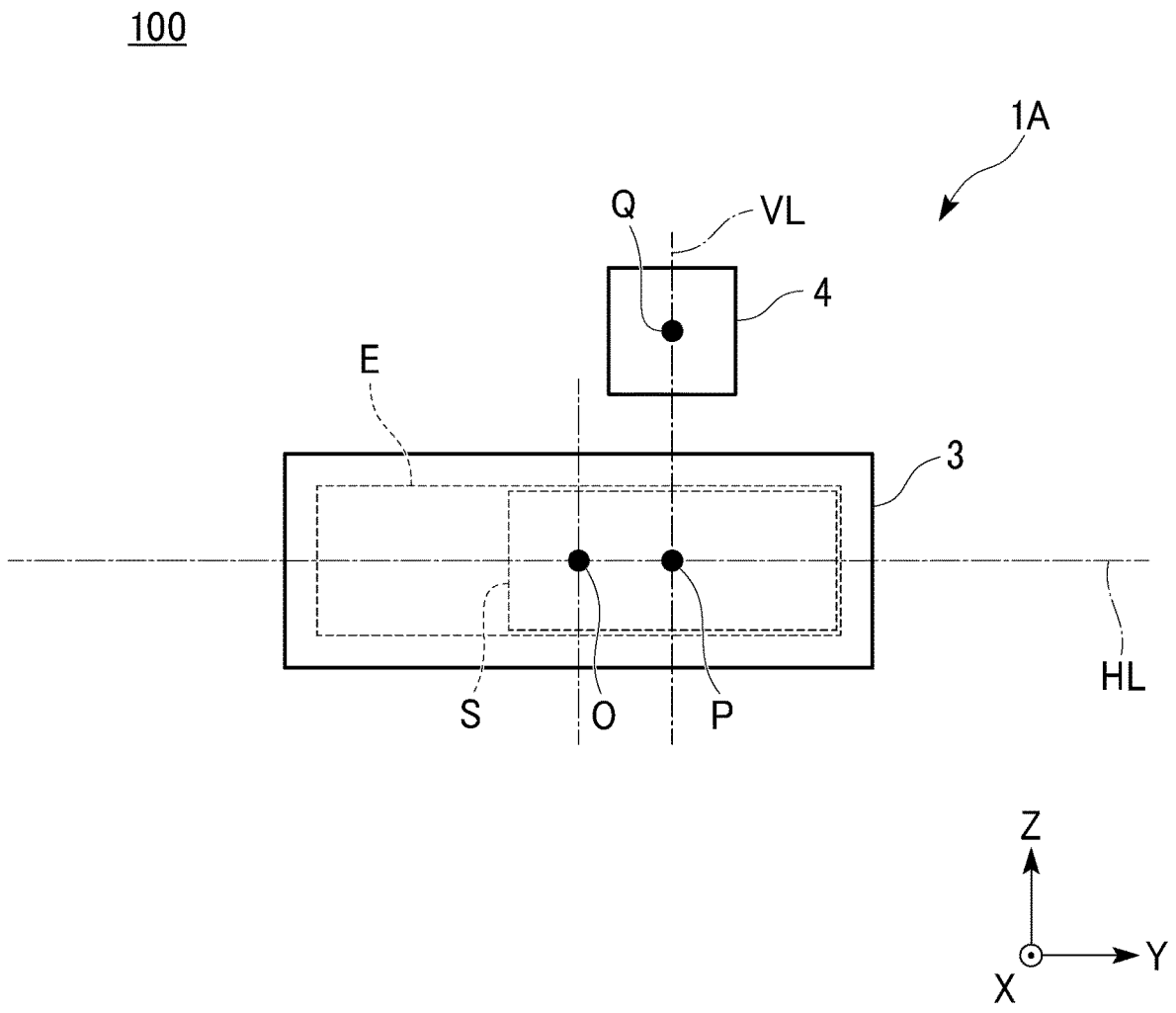
FIG. 3 is a front view of the illumination device showing a positional relation between a center of a laser beam irradiation region and a center of a scanning range of a laser beam.
Figure 4:
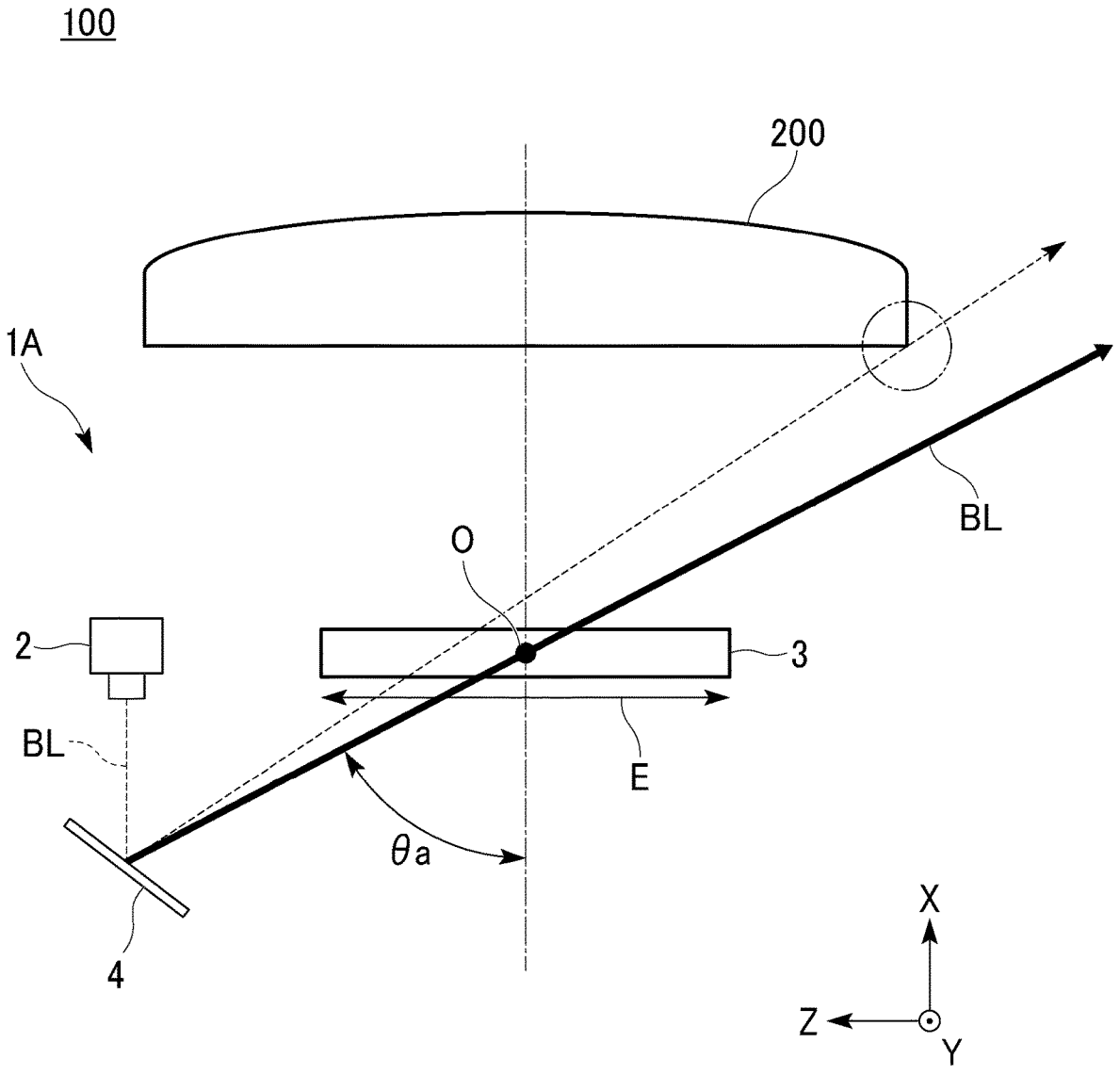
FIG. 4 is a plan view of the illumination device showing the positional relation between a center of a laser beam irradiation region and a center of a scanning range of a laser beam.

In addition, in the illumination devices 1A and 1B of the embodiment, as shown in FIG. 3 and FIG. 4, the laser light source 2 and a laser beam scanning mechanism 4 are disposed at a position corresponding to at least one of an upper side and a lower side of a light distribution pattern with respect to the wavelength conversion member 3, and furthermore, disposed to be deviated to either one of one side corresponding to the left side of the light distribution pattern and the other side corresponding to the right side of the light distribution pattern. The laser light source 2 and the laser beam scanning mechanism 4 of the illumination devices 1A and 1B of the embodiment are disposed to be deviated from a center of the wavelength conversion member 3 to either one of one side corresponding to the left side of the light distribution pattern with respect to the center of the wavelength conversion member and the other side corresponding to the right side of the light distribution pattern.

In addition, in the illumination devices 1A and 1B of the embodiment, when the wavelength conversion member 3 is seen in a plan view, a center P of a scanning range S of the laser beam BL is located at an intersection between a vertical line VL corresponding to the upward/downward direction of the light distribution pattern passing through a center Q of the laser beam scanning mechanism 4 and a horizontal line HL corresponding to the leftward/rightward direction of the light distribution pattern passing through a center O of a laser beam irradiation region E.

Here, the illumination devices 1A and 1B have basically the same configuration except that disposition of the laser light source 2, the laser beam scanning mechanism 4 and the reflector 5 is changed according to disposition of the transmission type wavelength conversion member 3A and the reflection type wavelength conversion member 3B mentioned above.

Accordingly, in the following description, the transmission type wavelength conversion member 3A and the reflection type wavelength conversion member 3B are collectively treated as "the wavelength conversion member 3," and the present invention can also be applied similarly to the reflection type illumination device 1B, even though the description of FIG. 3 and FIG. 4 exemplifies the transmission type illumination device 1A.

Further, FIG. 3 is a front view of the illumination device 1A showing a positional relation between the center O of the laser beam irradiation region E and the center P of the scanning range S of the laser beam BL. FIG. 4 is a plan view of the illumination device 1A showing a positional relation between the center O of the laser beam irradiation region E and the center P of the scanning range S of the laser beam BL.

Specifically, as shown in FIG. 3, the wavelength conversion member 3 has a rectangular (rectangle) laser irradiation region E when seen in a plan view (seen in the X-axis direction) to correspond to the light distribution pattern according to the scanning range S of the laser beam BL. In addition, a longitudinal direction of the laser irradiation region E corresponds to a leftward/rightward direction (Y-axis direction) of the light distribution pattern, and a short side direction of the laser irradiation region E corresponds to an upward/downward direction (Z-axis direction) of the light distribution pattern.

Accordingly, the laser beam irradiation region E has a so-called horizontally elongated shape in which a width corresponding to the leftward/rightward direction of the light distribution pattern is greater than a height corresponding to the upward/downward direction of the light distribution pattern when the wavelength conversion member 3 is seen in a plan view.

In addition, the light distribution pattern when the illumination light WL radiated toward the side in front of the vehicle lamp 100 is projected to a virtual vertical screen facing the vehicle lamp 100 also has a horizontally elongated shape. According to this, disposition of the laser beam scanning mechanism 4 and control thereof are performed such that the scanning range S of the laser beam L with respect to the laser scanning region E of the wavelength conversion member 3 is also horizontally elongated.

Specifically, as shown in FIG. 3 and FIG. 4, the laser beam scanning mechanism 4 is located at a position corresponding to an upper side or a lower side (in the embodiment, the upper side) of the short side direction of the light distribution pattern with respect to the laterally elongated wavelength conversion member 3. Here, as shown in FIG. 4, an incidence angle of the laser beam BL entering the center O of the laser beam irradiation region E is θa.

Figure 5:
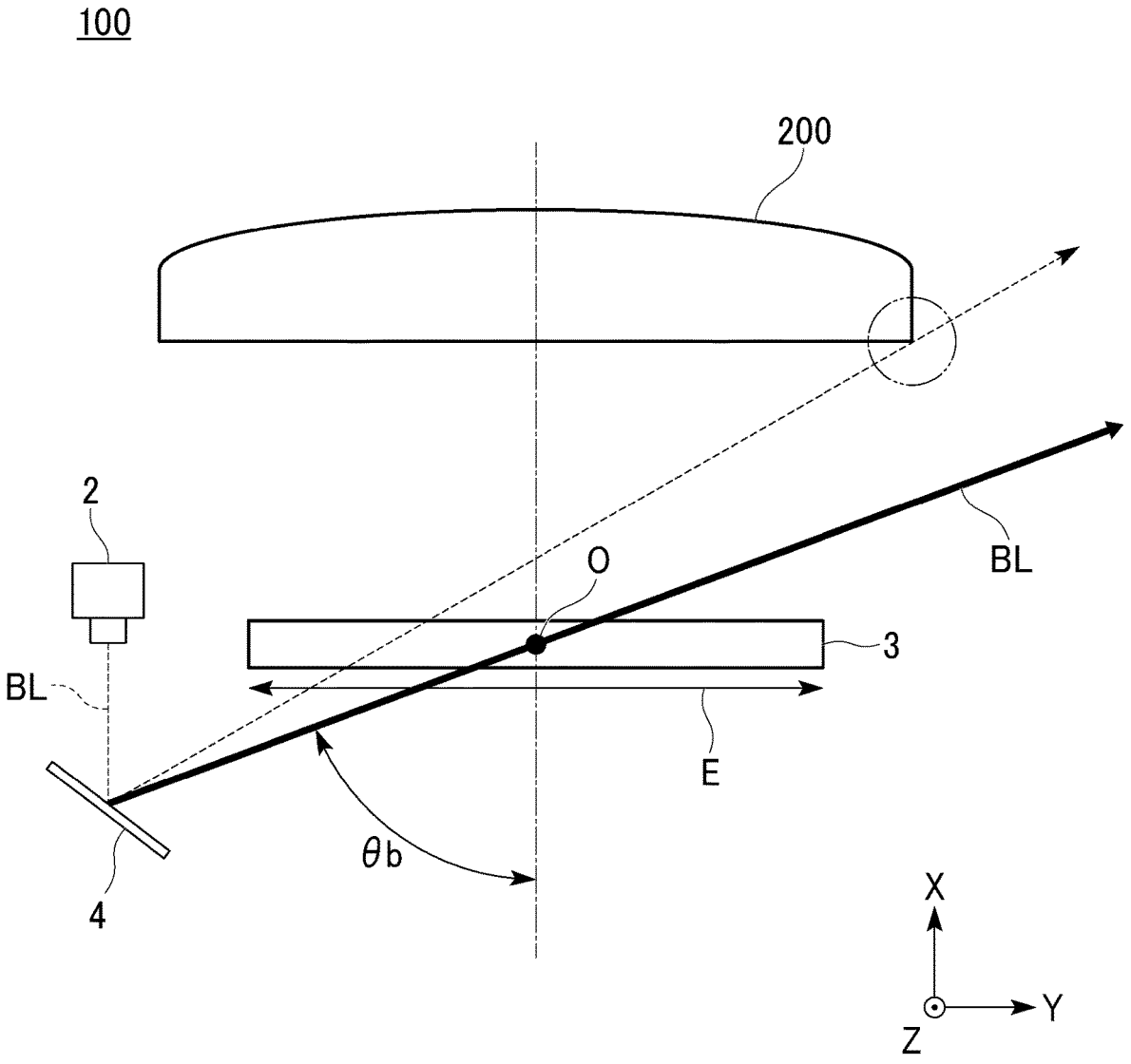
FIG. 5 is a plan view of the illumination device showing a case in which a center of a scanning range of a laser beam is located at a center of a laser beam irradiation region for comparison.

Meanwhile, for comparison, a case in which the laser beam scanning mechanism 4 is located at a position corresponding to the left side or the right side (in the embodiment, the left side) of the longitudinal direction of the light distribution pattern with respect to the wavelength conversion member 3 is shown in FIG. 5. Here, as shown in FIG. 5, an incidence angle of the laser beam BL entering the center O of the laser beam irradiation region E is Ob.

In the case in which the incidence angle of the laser beam BL with respect to the wavelength conversion member 3 is set to an angle where the laser beam BL does not directly enter the projection lens 200, if the MEMS mirror of the laser beam scanning mechanism 4 is operated at the same deflection angle, the incidence angle θa shown in FIG. 4 can be made smaller than the incidence angle θb shown in FIG. 5.

Accordingly, when the above-mentioned laser beam scanning mechanism 4 is located at a position corresponding to the upper side or the lower side of the short side direction of the light distribution pattern with respect to the wavelength conversion member 3, a spot size of the laser beam BL radiated to the wavelength conversion member 3 can be reduced. Accordingly, resolution of the light distribution pattern formed by the above-mentioned ADB can be increased.

Figure 6:
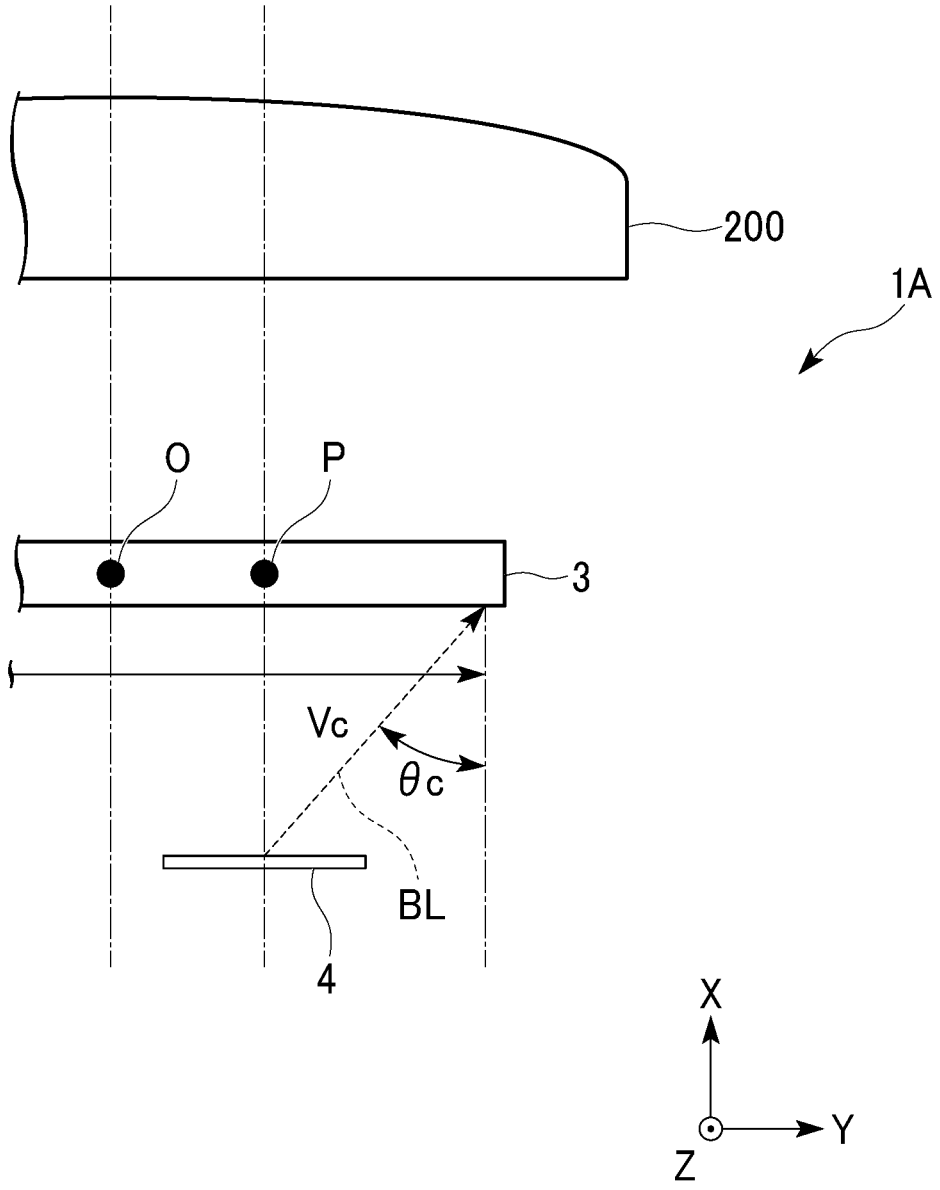
FIG. 6 is a schematic diagram showing an incidence vector and an incidence angle of a laser beam entering an end portion of the laser beam irradiation region from the laser beam scanning mechanism of the illumination device shown in FIG. 4.

In addition, as shown in FIG. 3 and FIG. 4, in a case in which the laser beam scanning mechanism 4 on the upper side is disposed to be deviated to either one of one side corresponding to the left side of the longitudinal direction of the light distribution pattern and the other side corresponding to the right side of the longitudinal direction of the light distribution pattern (in the embodiment, the right side), as shown in FIG. 6, an incidence angle of the laser beam BL on the upper side, which enters the end portion of the laser beam irradiation region E on the right side, with respect to a normal line (X axis) of the wavelength conversion member 3 is set as θc, and set as an incidence vector Vc of the laser beam BL on the upper side.

Figure 7:
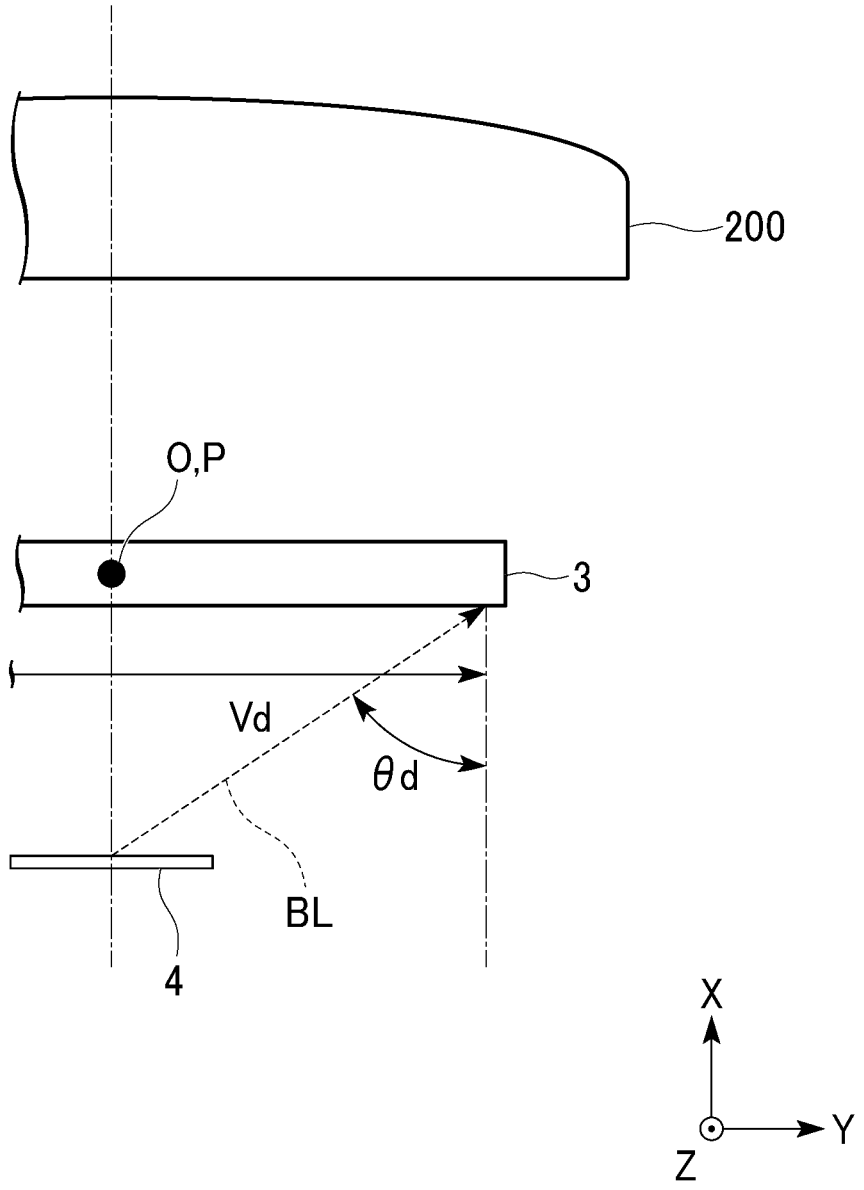
FIG. 7 is a schematic diagram showing an incidence vector and an incidence angle of a laser beam on the upper side entering an end portion of the laser beam irradiation region from the laser beam scanning mechanism located on the upper center side for comparison.

Meanwhile, for comparison, a case in which the laser beam scanning mechanism 4 is located on an upper center side with respect to the wavelength conversion member 3 is shown in FIG. 7. In this case, an incidence angle of the laser beam BL on the upper side, which enters the end portion of the laser beam irradiation region E on the right side, with respect to the normal line (X axis) of the wavelength conversion member 3 is set as Od, and set as an incidence vector Vd of the laser beam BL on the upper side.

In the case in which the incidence angle of the above mentioned laser beam BL with respect to the wavelength conversion member 3 is set to an angle where the laser beam BL does not directly enter the projection lens 200, if the MEMS mirror of the laser beam scanning mechanism 4 is operated at the same deflection angle, the incidence angle θc shown in FIG. 6 is possible to become smaller than the incidence angle θd shown in FIG. 7.

Incidentally, in the case in which the resonance type MEMS mirror is used as the laser beam scanning mechanism 4, if a driving voltage is applied to the MEMS mirror according to a driving signal of a sine wave, a speed when the MEMS mirror reciprocally swings is maximized in the vicinity of the center of the laser beam irradiation region E, and minimized in the vicinity of both left and right ends of the laser beam irradiation region E. According to this, the light intensity distribution on the surface of the laser beam irradiation region E is relatively increased in the vicinity of both left and right ends of the laser beam irradiation region E in which the speed is reduced.

A correction mirror can be used as a means configured to optically correct the light intensity distribution. The correction mirror can flatten the light intensity distribution by optically stretching the vicinity of both left and right ends of the laser beam irradiation region E where brightness is increased. However, according to this, the spot sizes in the vicinity of both left and right ends of the laser beam irradiation region E are increased. In addition, as the scanning range S of the laser beam BL widens, correction in the vicinity of both left and right ends of the laser beam irradiation region E becomes necessary, and the spot sizes increase.

On the other hand, the laser beam scanning mechanism 4 on the upper side can reduce the incidence angle θc in the vicinity of left and right end portions of the light intensity distribution on the surface of the laser beam irradiation region E by deviating the center P of the scanning range S of the laser beam BL on the upper side toward the right side with respect to the center O of the laser beam irradiation region E.

Accordingly, in the vehicle lamp 100 including the illumination devices 1A and 1B of the embodiment, it is possible to reduce the scanning range S of the laser beam BL on the upper side, and prevent the spot sizes in the vicinity of both left and right ends of the laser beam irradiation region E from increasing. Accordingly, it is possible to increase resolution of the light distribution pattern formed by the above-mentioned ADB.

Second Embodiment

Next, as a second embodiment of the present invention, for example, the vehicle lamp 100 including an illumination device 1C shown in FIG. 8 and FIG. 9 will be described.

Figure 8:
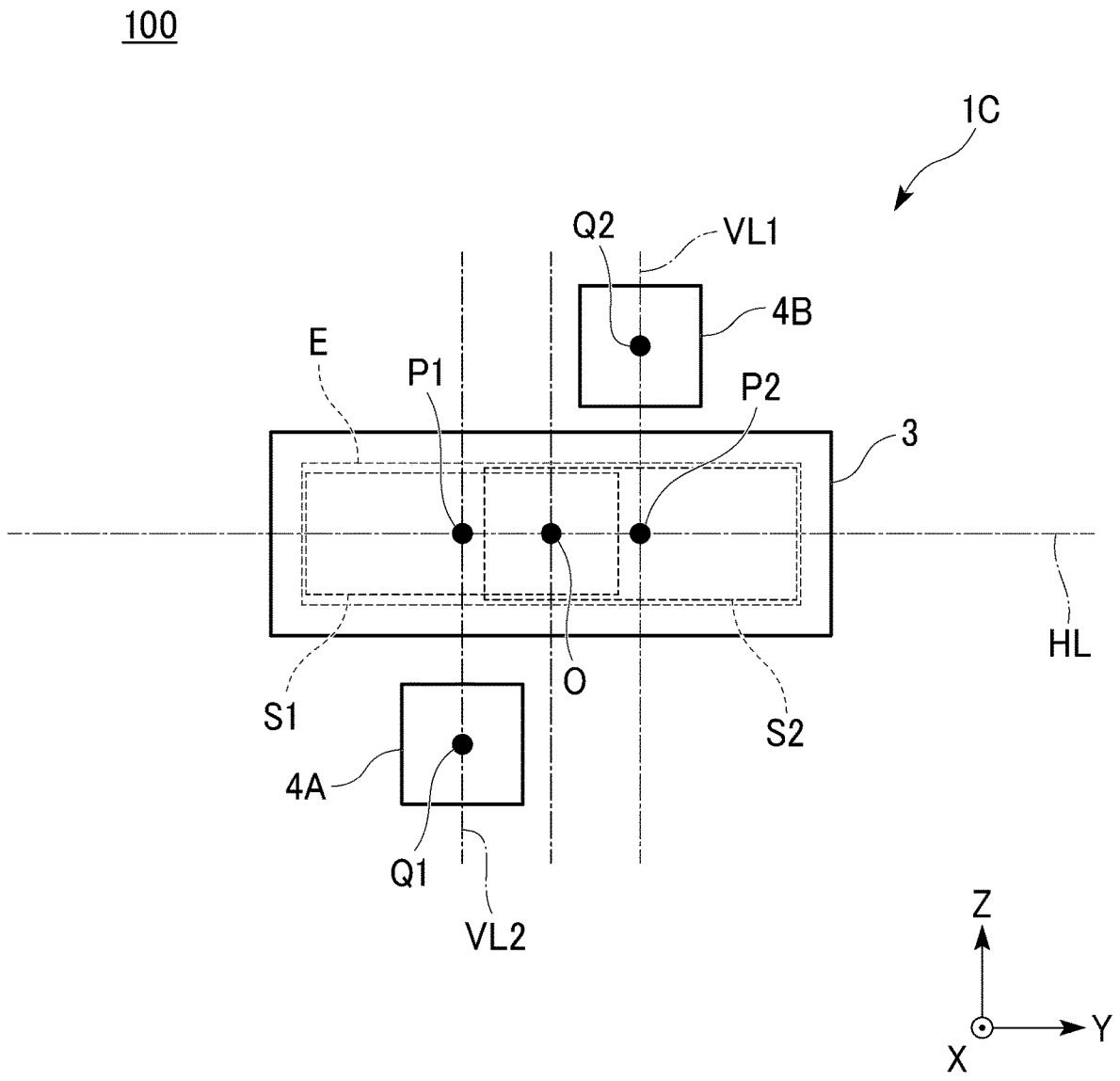
FIG. 8 is a schematic diagram showing a configuration of a vehicle lamp including an illumination device according to a second embodiment of the present invention.

Further, FIG. 8 is a schematic diagram showing a configuration of the vehicle lamp 100 including the illumination device 1C. FIG. 9 is a front view showing a positional relation between the center O of the laser beam irradiation region E of the illumination device 1C, the center P1 of the scanning range S1 of the laser beam BL1 on the lower left side and the center P2 of the scanning range S2 of the laser beam BL2 on the upper right side.

In addition, in the following description, the same parts of the illumination devices 1A and 1B are designated by the same reference signs in the drawings and description thereof will be omitted. In addition, the transmission type wavelength conversion member 3A and the reflection type wavelength conversion member 3B are collectively treated as "the wavelength conversion member 3," and the present invention can also be applied to the reflection type illumination device, even though the description of FIG. 8 and FIG. 9 exemplifies the transmission type illumination device 1C.

Figure 9:
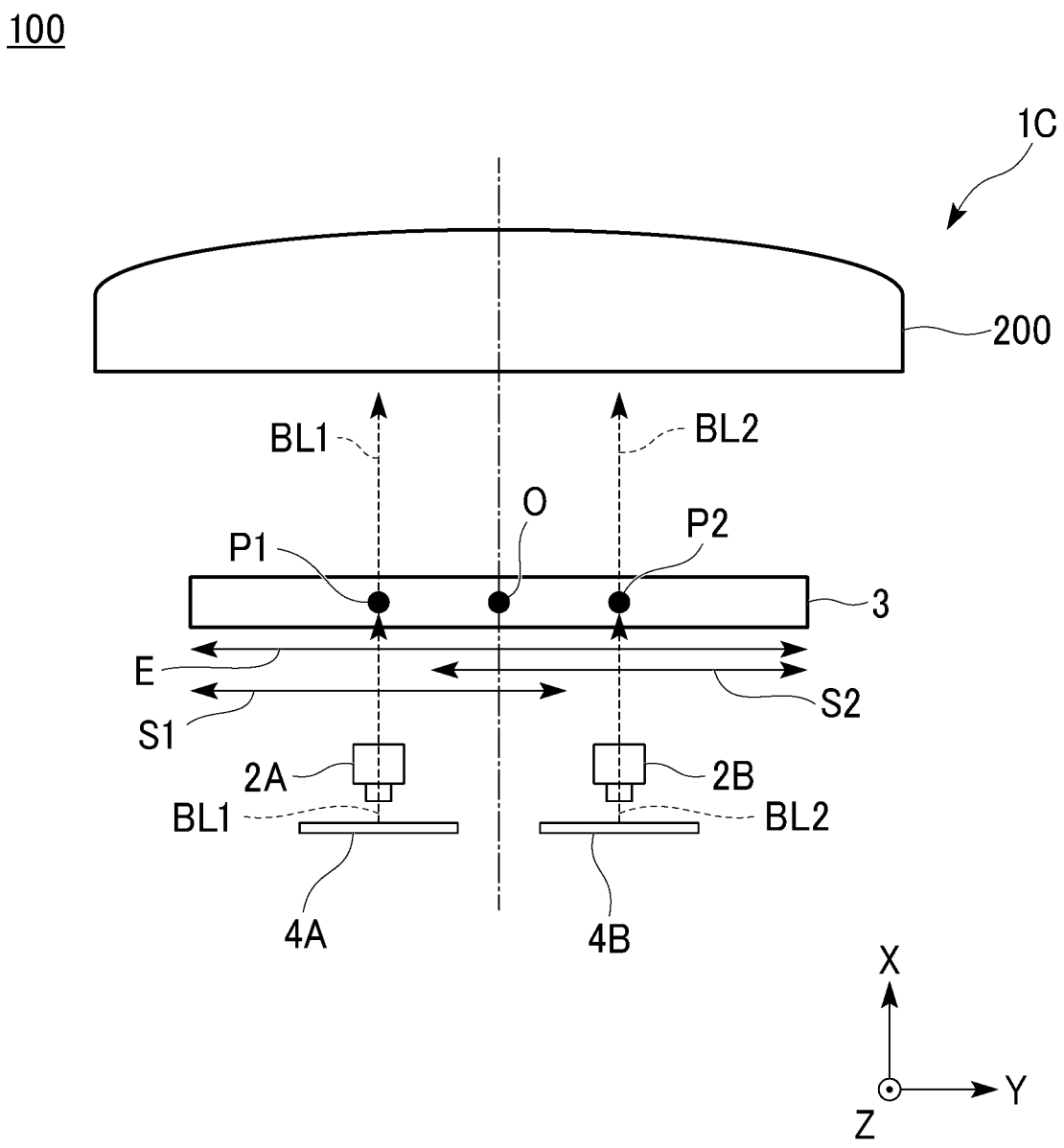
FIG. 9 is a front view showing a positional relation between a center of a laser beam irradiation region of the illumination device shown in FIG. 8, a center of a scanning range of a laser beam on a lower left side, and a center of a scanning range of a laser beam on an upper right side.

As shown in FIG. 8 and FIG. 9, the vehicle lamp 100 including the illumination device 1C of the embodiment includes the laser light source 2A and the laser beam scanning mechanism 4A on the lower left side that are located at a position corresponding to the lower side of the short side direction of the light distribution pattern with respect to the wavelength conversion member 3 and that are disposed to be deviated to the left side (one side) of the longitudinal direction of the light distribution pattern, and the laser light source 2B and the laser beam scanning mechanism 4B on the upper right side that are located at a position corresponding to the upper side of the short side direction of the light distribution pattern with respect to the wavelength conversion member 3 and that are disposed to be deviated to the right side (the other side) of the longitudinal direction of the light distribution pattern. Other than that, it has basically the same configuration as the vehicle lamp 100 including the illumination device 1A. The laser light source 2A and the laser beam scanning mechanism 4A of the vehicle lamp 100 including the illumination device 1C of the embodiment are disposed on the left side (one side) of the longitudinal direction of the light distribution pattern to be deviated with respect to the center of the wavelength conversion member 3. The laser light source 2B and the laser beam scanning mechanism 4B of the vehicle lamp 100 including the illumination device 1C of the embodiment are disposed on the right side (the other side) of the longitudinal direction of the light distribution pattern to be deviated with respect to the center of the wavelength conversion member 3.

The laser beam scanning mechanism 4A on the lower left side forms a light distribution pattern according to the scanning range S1 of the laser beam BL1 on the lower left side by scanning the laser beam BL1 on the lower left side (one side) radiated toward the laser beam irradiation region E from the laser light source 2A on the lower left side.

The laser beam scanning mechanism 4B on the upper right side forms a light distribution pattern according to the scanning range S2 of the laser beam BL2 on the upper right side by scanning the laser beam BL2 on the upper right side (the other side) radiated toward the laser beam irradiation region E from the laser light source 2B on the upper right side.

In the illumination device 1C of the embodiment, one synthesis light distribution pattern is formed by overlapping the light distribution pattern according to the scanning range S1 of the laser beam BL1 on the lower left side and the light distribution pattern according to the scanning range S2 of the laser beam BL2 on the upper right side.

In addition, in the illumination device 1C of the embodiment, when the wavelength conversion member 3 is seen in a plan view, the center P1 of the scanning range S1 of the laser beam BL1 on the lower left side is located at an intersection between the vertical line VL1 corresponding to the upward/downward direction of the light distribution pattern passing through the center Q1 of the laser beam scanning mechanism 4A on the lower left side and the horizontal line HL corresponding to the leftward/rightward direction of the light distribution pattern passing through the center O of the laser beam irradiation region E. On the other hand, the center P2 of the scanning range S2 of the laser beam BL2 on the upper right side is located at an intersection between the vertical line VL2 corresponding to the upward/downward direction of the light distribution pattern passing through the center Q2 of the laser beam scanning mechanism 4B on the upper right side and the horizontal line HL corresponding to the leftward/rightward direction of the light distribution pattern passing through the center O of the laser beam irradiation region E.

Accordingly, in the illumination device 1C of the embodiment, when the wavelength conversion member 3 is seen in a plan view, the center P1 of the scanning range S1 of the laser beam BL1 on the lower left side and the center P2 of the scanning range S2 of the laser beam BL2 on the upper right side are located on the left side and the right side with the center O of the laser beam irradiation region E sandwiched therebetween.

In the illumination device 1C of the embodiment having the above-mentioned configuration, an incidence angle of the laser beams BL1 and BL2 on the lower left side and the upper right side, which are scanned by the laser beam scanning mechanisms 4A and 4B on the lower left side and the upper right side, with respect to the wavelength conversion member 3 is set to an angle where the laser beams BL1 and BL2 do not directly enter the projection lens 200 when the wavelength conversion member 3 is damaged, chipped or fallen off.

Accordingly, in the vehicle lamp 100 including the illumination device 1C of the embodiment, even when flaws, damage, falling off, or the like occurs in the wavelength conversion member 3, it is possible to prevent the laser beams BL1 and BL2 on the lower left side and the upper right side, which are scanned by the laser beam scanning mechanisms 4A and 4B on the lower left side and the upper right side, from being directly emitted to the outside through the projection lens 200.

In addition, in the illumination device 1C of the embodiment, the laser beam scanning mechanisms 4A and 4B on the lower left side and the upper right side are located at positions corresponding to the lower side and the upper side of the short side direction of the light distribution pattern with respect to the wavelength conversion member 3, and furthermore, is disposed to be deviated to one side corresponding to the left side of the longitudinal direction of the light distribution pattern and the other side corresponding to the right side of the longitudinal direction of the light distribution pattern, respectively. The laser beam scanning mechanisms 4A and 4B of the illumination device 1C of the embodiment are disposed to be deviated to one side corresponding to the left side of the longitudinal direction of the light distribution pattern and the other side corresponding to the right side of the longitudinal direction of the light distribution pattern with respect to the center of the wavelength conversion member 3, respectively.

Further, in the illumination device 1C of the embodiment, when the wavelength conversion member 3 is seen in a plan view, the center P1 of the scanning range S1 of the laser beam BL1 on the lower left side and the center P2 of the scanning range S2 of the laser beam BL2 on the upper right side are disposed on the left side and the right side with the center O of the laser beam irradiation region E sandwiched therebetween.

Accordingly, in the vehicle lamp 100 including the illumination device 1C of the embodiment, it is possible to reduce the spot sizes of the laser beams BL1 and BL2 on the lower left side and the upper right side radiated to the wavelength conversion member 3. As a result, it is possible to increase resolution of the light distribution pattern formed by the above-mentioned ADB.

Third Embodiment

Next, as a third embodiment of the present invention, for example, the vehicle lamp 100 including an illumination device 1D shown in FIG. 10 and FIG. 11 will be described.

Figure 10:
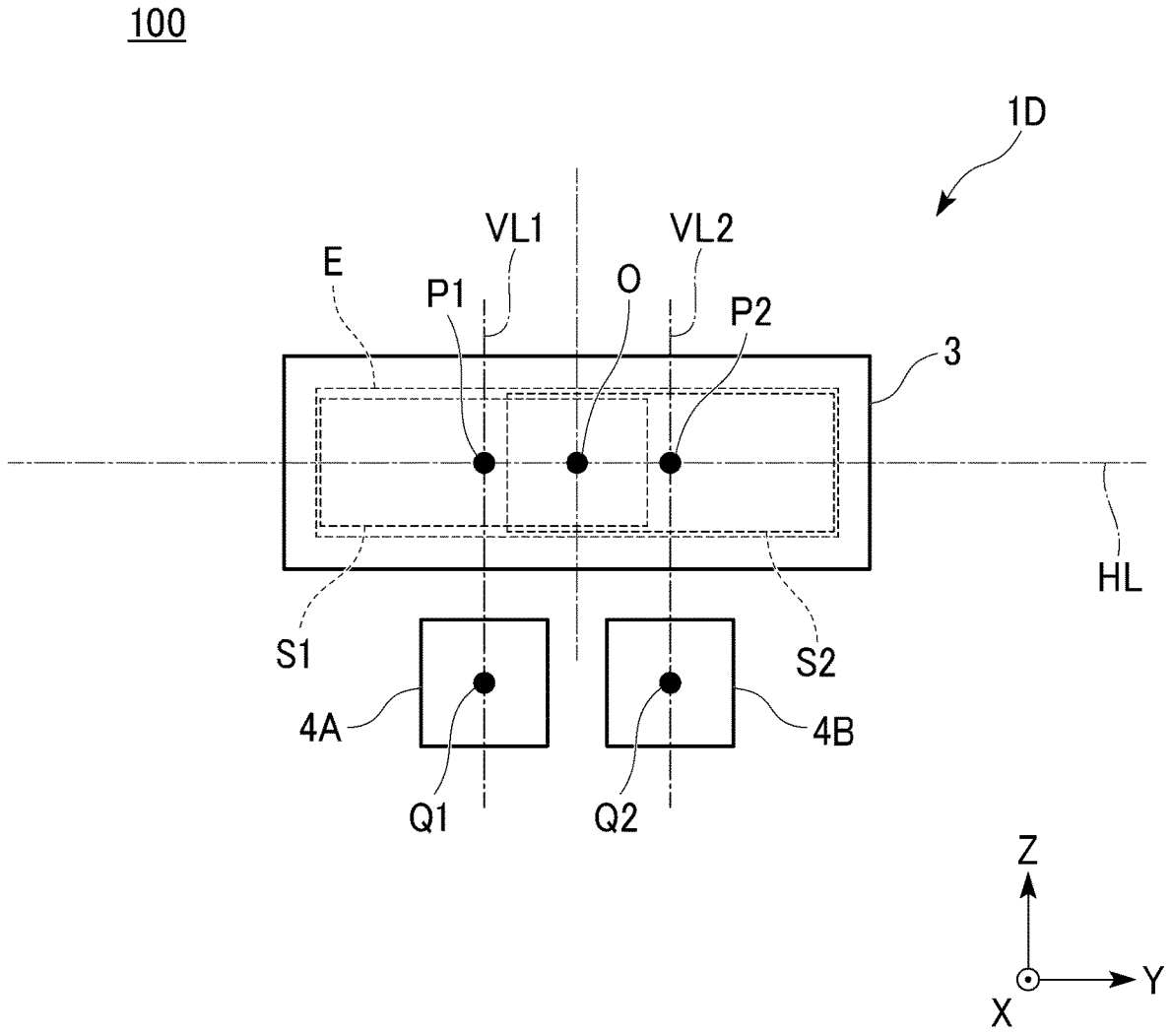
FIG. 10 is a schematic diagram showing a configuration of a vehicle lamp including an illumination device according to a third embodiment of the present invention.

Further, FIG. 10 is a schematic diagram showing a configuration of the vehicle lamp 100 including the illumination device 1D. FIG. 11 is a front view showing a positional relation between the center O of the laser beam irradiation region E of the illumination device 1D, the center P1 of the scanning range S1 of the laser beam BL1 on the lower left side and the center P2 of the scanning range S2 of the laser beam BL2 on the lower right side.

In addition, in the following description, the same parts as the illumination devices 1A and 1B are designated by the same reference signs in the drawings and description thereof will be omitted. In addition, the transmission type wavelength conversion member 3A and the reflection type wavelength conversion member 3B are collectively treated as "the wavelength conversion member 3," and the present invention can also be applied similarly to the reflection type illumination device although the description is performed while exemplifying the transmission type illumination device 1D in FIG. 10 and FIG. 11.

Figure 11:
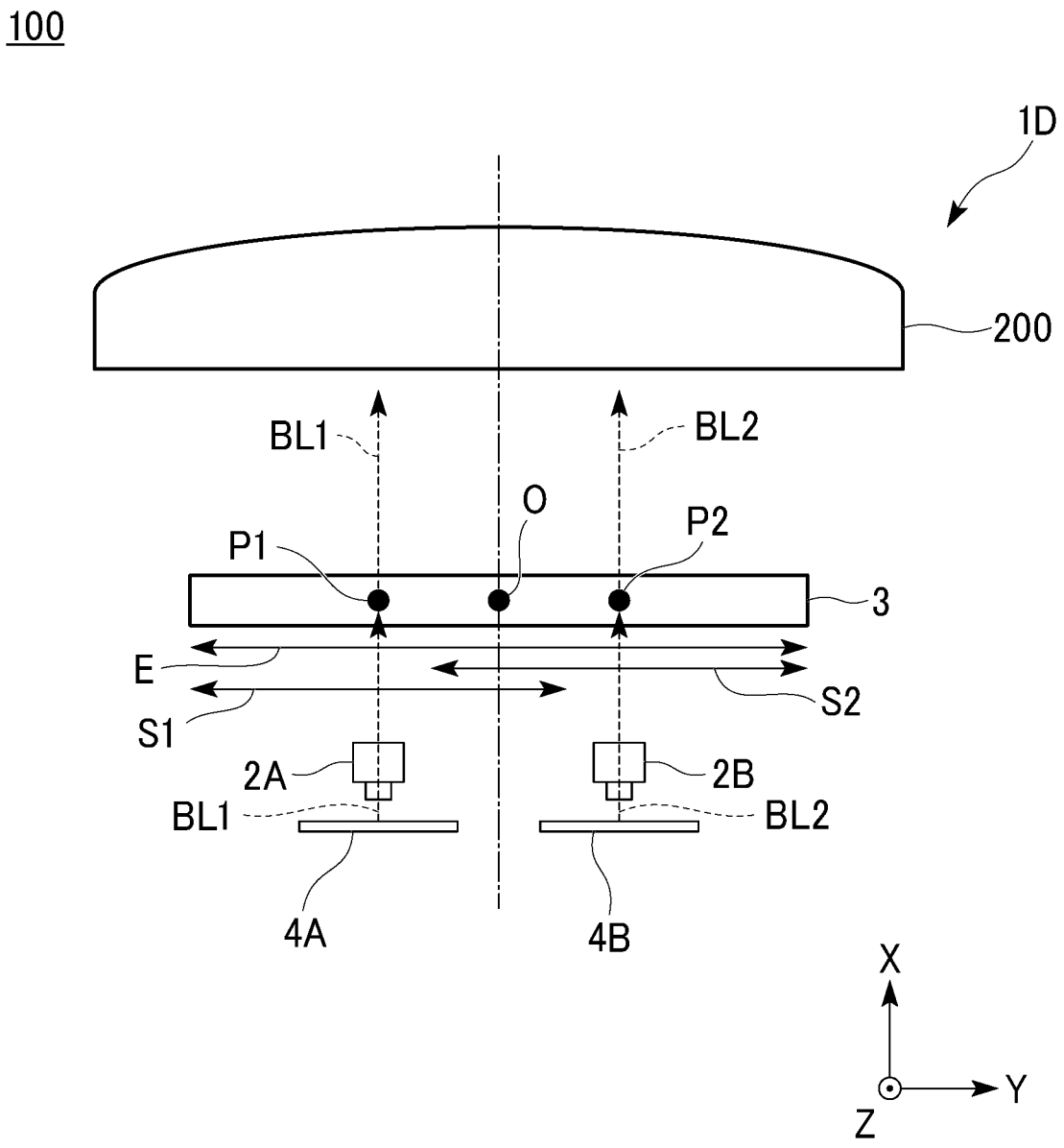
FIG. 11 is a front view showing a positional relation between a center of a laser beam irradiation region of the illumination device shown in FIG. 10, a center of a scanning range of a laser beam on a lower left side, and a center of a scanning range of a laser beam on a lower right side.

As shown in FIG. 10 and FIG. 11, the vehicle lamp 100 including the illumination device 1D of the embodiment has the laser light source 4A and the laser beam scanning mechanism 4A on the lower left side that are disposed at positions corresponding to the lower side of the short side direction of the light distribution pattern with respect to the wavelength conversion member 3 and that are disposed to be deviated to the left side (one side) of the longitudinal direction of the light distribution pattern, and has the laser light source 4B and the laser beam scanning mechanism 4B on the lower right side that are disposed at positions corresponding to the lower side of the short side direction of the light distribution pattern with respect to the wavelength conversion member 3 and that are disposed to be deviated to the right side (the other side) of the longitudinal direction of the light distribution pattern. Other than that, it has basically the same configuration as that of the vehicle lamp 100 including the illumination device 1C. The laser light source 4A and the laser beam scanning mechanism 4A of the vehicle lamp 100 including the illumination device 1D of the embodiment are disposed on the left side (one side) of the longitudinal direction of the light distribution pattern to be deviated with respect to the center of the wavelength conversion member 3. The laser light source 4B and the laser beam scanning mechanism 4B of the vehicle lamp 100 including the illumination device 1D of the embodiment are disposed on the right side (the other side) of the longitudinal direction of the light distribution pattern to be deviated with respect to the center of the wavelength conversion member 3.

The laser beam scanning mechanism 4A on the lower left side forms a light distribution pattern according to the scanning range S1 of the laser beam BL1 on the lower left side by scanning the laser beam BL1 of the lower left side (one side) radiated toward the laser beam irradiation region E from the laser light source 2A on the lower left side.

The laser beam scanning mechanism 4B on the lower right side forms a light distribution pattern according to the scanning range S2 of the laser beam BL2 on the lower right side by scanning the laser beam BL2 on the lower right side (the other side) radiated toward the laser beam irradiation region E from the laser light source 2A on the lower right side.

In the illumination device 1D of the embodiment, one synthesis light distribution pattern is formed by overlapping the light distribution pattern according to the scanning range S1 of the laser beam BL1 on the lower left side and the light distribution pattern according to the scanning range S2 of the laser beam BL2 on the lower right side.

In addition, in the illumination device 1D of the embodiment, when the wavelength conversion member 3 is seen in a plan view, the center P1 of the scanning range S1 of the laser beam BL1 on the lower left side is located at an intersection between the vertical line VL1 corresponding to the upward/downward direction of the light distribution pattern passing through the center Q1 of the laser beam scanning mechanism 4A on the lower left side and the horizontal line HL corresponding to the leftward/rightward direction of the light distribution pattern passing through the center O of the laser beam irradiation region E. On the other hand, the center P2 of the scanning range S2 of the laser beam BL2 on the lower right side is located at an intersection between the vertical line VL2 corresponding to the upward/downward direction of the light distribution pattern passing through the center Q2 of the laser beam scanning mechanism 4B on the lower right side and the horizontal line HL corresponding to the leftward/rightward direction of the light distribution pattern passing through the center O of the laser beam irradiation region E.

Accordingly, in the illumination device 1D of the embodiment, when the wavelength conversion member 3 is seen in a plan view, the center P1 of the scanning range S1 of the laser beam BL1 on the lower left side and the center P2 of the scanning range S2 of the laser beam BL2 on the lower right side is located on the left side and the right side with the center O of the laser beam irradiation region E sandwiched therebetween.

In the illumination device 1D of the embodiment having the above-mentioned configuration, the incidence angles of the laser beams BL1 and BL2 on the lower left side and the lower right side, which are scanned by the laser beam scanning mechanisms 4A and 4B on the lower left side and the lower right side, with respect to the wavelength conversion member 3 are set to angles where the laser beams BL1 and BL2 do not directly enter the projection lens 200 when the wavelength conversion member 3 is damaged, chipped or peeled off.

Accordingly, in the vehicle lamp 100 including the illumination device 1D of the embodiment, even when flaws, damage, falling off, or the like occurs in the wavelength conversion member 3, it is possible to prevent the laser beams BL1 and BL2 on the lower left side and the lower right side, which are scanned by the laser beam scanning mechanisms 4A and 4B on the lower left side and the lower right side, from being emitted directly to the outside through the projection lens 200.

In addition, in the illumination device 1D of the embodiment, the laser beam scanning mechanisms 4A and 4B on the lower left side and the lower right side are disposed at positions corresponding to the lower side of the short side direction of the light distribution pattern with respect to the wavelength conversion member 3, and furthermore, are disposed to be deviated to the one side corresponding to the left side of the longitudinal direction of the light distribution pattern and the other side corresponding to the right side of the longitudinal direction of the light distribution pattern, respectively. The laser beam scanning mechanisms 4A and 4B of the illumination device 1D of the embodiment are disposed on the one side corresponding to the left side of the longitudinal direction of the light distribution pattern and the other side corresponding to the right side of the longitudinal direction of the light distribution pattern, respectively, so as to be deviated with respect to the center of the wavelength conversion member 3.

Further, in the illumination device 1D of the embodiment, when the wavelength conversion member 3 is seen in a plan view, the center P1 of the scanning range S1 of the laser beam BL1 on the lower left side and the center P2 of the scanning range S2 of the laser beam BL2 on the lower right side are located on the left side and the right side with the center O of the laser beam irradiation region E sandwiched therebetween.

Accordingly, in the vehicle lamp 100 including the illumination device 1D of the embodiment, it is possible to reduce spot sizes of the laser beams BL1 and BL2 on the lower left side and the lower right side radiated to the wavelength conversion member 3. As a result, it is possible to increase resolution of the light distribution pattern formed by the above-mentioned ADB.

Fourth Embodiment

Next, as a fourth embodiment of the present invention, for example, the vehicle lamp 100 including an illumination device 1E shown in FIG. 12 and FIG. 13 will be described.

Figure 12:
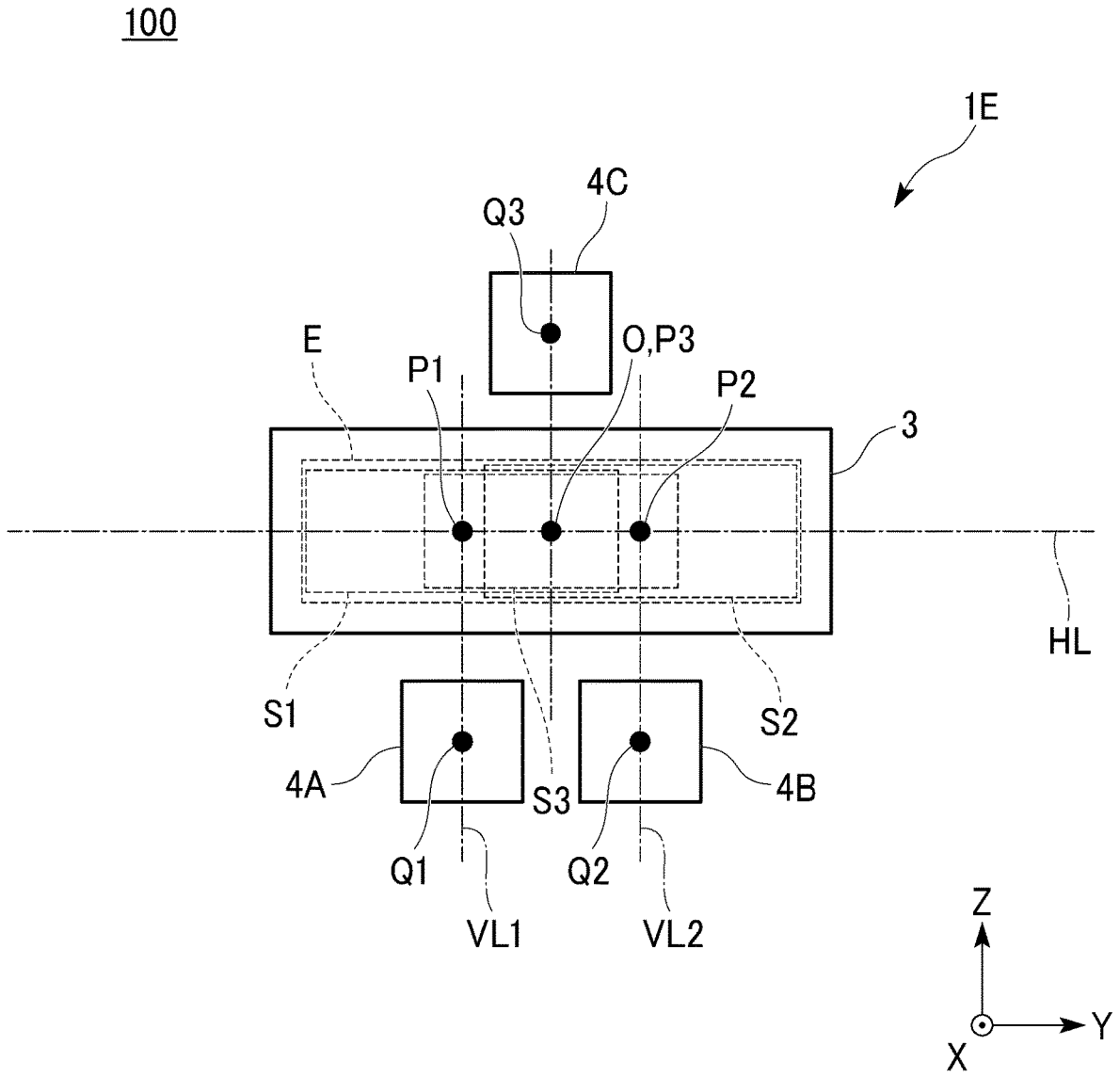
FIG. 12 is a schematic diagram showing a configuration of a vehicle lamp including an illumination device according to a fourth embodiment of the present invention.

Further, FIG. 12 is a schematic diagram showing a configuration of the vehicle lamp 100 including the illumination device 1E. FIG. 11 is a front view showing a positional relation between the center O of the laser beam irradiation region E of the illumination device 1E, the center P1 of the scanning range S1 of the laser beam BL1 on the lower left side, the center P2 of the scanning range S2 of the laser beam BL2 on the lower right side and the center P3 of the scanning range S3 of the laser beam BL3 on the upper center side.

In addition, in the following description, the same parts as the illumination device 1D are designated by the same reference signs in the drawings and description thereof will be omitted. In addition, the transmission type wavelength conversion member 3A and the reflection type wavelength conversion member 3B are collectively treated as "the wavelength conversion member 3," the present invention can also be applied similarly to the reflection type illumination device although the description is performed while exemplifying the transmission type illumination device 1E in FIG. 12 and FIG. 13.

Figure 13:
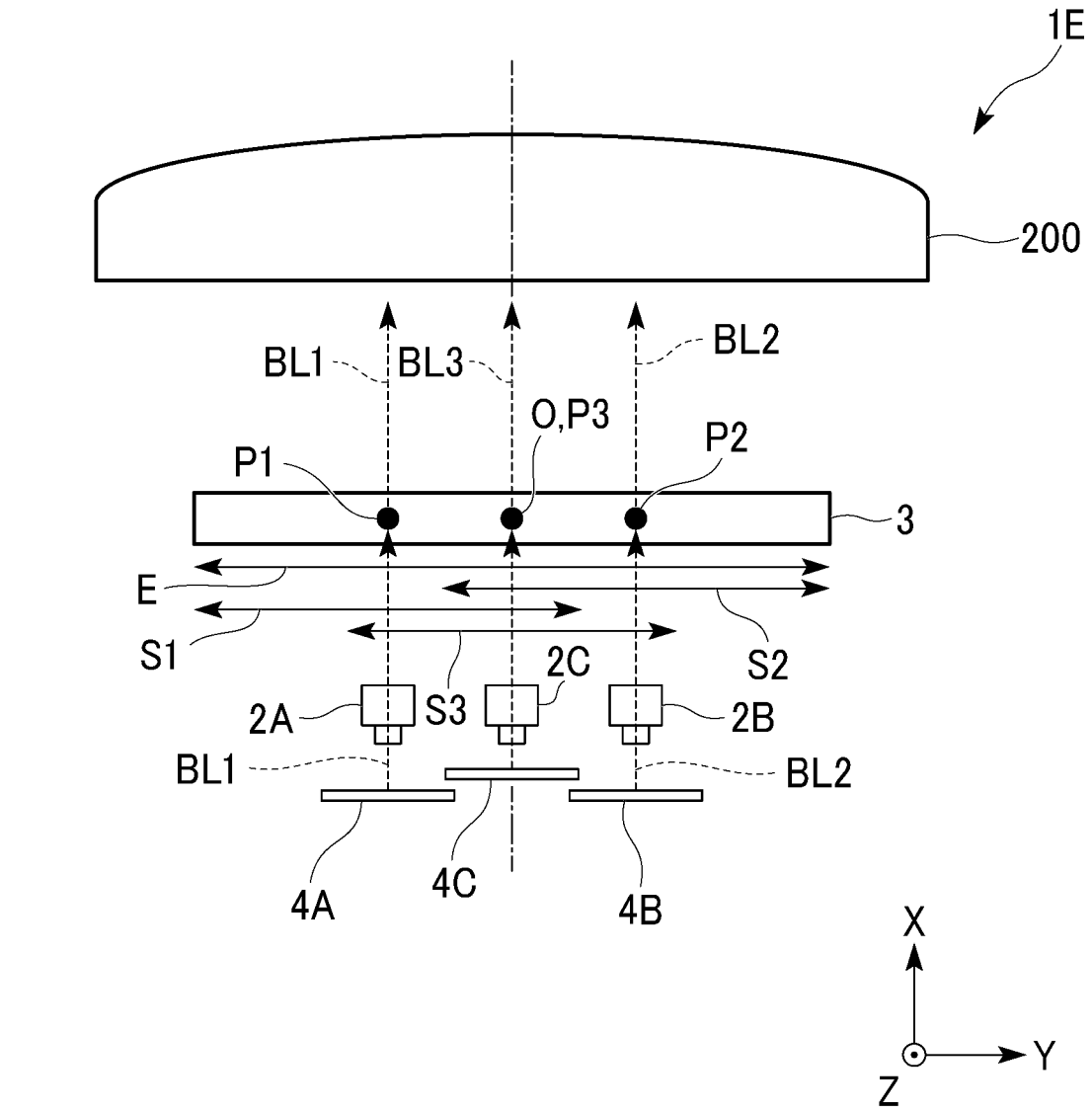
FIG. 13 is a front view showing a positional relation between a center of a laser beam irradiation region of the illumination device shown in FIG. 12, a center of a scanning range of a laser beam on a lower left side, a center of a scanning range of a laser beam on a lower right side, and a center of a scanning range of a laser beam on an upper center side.

As shown in FIG. 12 and FIG. 13, the vehicle lamp 100 including the illumination device 1E of the embodiment has the laser light source 2C and the laser beam scanning mechanism 4C on the upper center side additionally disposed on either one of the upper side (one side) and the lower side (the other side) (in the embodiment, the upper side) of the short side direction of the light distribution pattern with respect to the wavelength conversion member 3, in addition to the configuration of the illumination device 1D.

The laser beam scanning mechanism 4C on the upper center side forms a light distribution pattern according to the scanning range S3 of the laser beam BL3 on the upper center side by scanning the laser beam BL3 on the upper center side (additional) radiated toward the laser beam irradiation region E from the laser light source 2C on the upper center side.

In the illumination device 1E of the embodiment, one synthesis light distribution pattern is formed by overlapping the light distribution pattern according to the scanning range S1 of the laser beam BL1 on the lower left side, the light distribution pattern according to the scanning range S2 of the laser beam BL2 on the lower right side, and the light distribution pattern according to the scanning range S3 of the laser beam BL3 on the upper center side.

In addition, in the illumination device 1E of the embodiment, when the wavelength conversion member 3 is seen in a plan view, the center P3 of the scanning range S3 of the laser beam BL3 on the upper center side is located at an intersection between the vertical line VL3 corresponding to the upward/downward direction of the light distribution pattern passing through the center Q3 of the laser beam scanning mechanism 4C on the upper center side and the horizontal line HL corresponding to the leftward/rightward direction of the light distribution pattern passing through the center O of the laser beam irradiation region E.

Further, in the embodiment, the center P3 of the scanning range S3 of the laser beam BL3 on the upper center side is located at a position that matches with the center O of the laser beam irradiation region E.

In the illumination device 1E of the embodiment having the above-mentioned configuration, incidence angles of the laser beams BL1, BL2 and BL3 on the lower left side, the lower right side and the upper center side, which are scanned by the laser beam scanning mechanisms 4A, 4B and 4C on the lower left side, the lower right side and the upper center side, with respect to the wavelength conversion member 3 are set to angles where the laser beams BL1, BL2 and BL3 do not directly enter the projection lens 200 when the wavelength conversion member 3 is damaged, chipped or fallen off.

Accordingly, in the vehicle lamp 100 including the illumination device 1E of the embodiment, even when flaws, damage, falling off, or the like occurs in the wavelength conversion member 3, it is possible to prevent the laser beams BL1, BL2 and BL3 on the lower left side, the lower right side and the upper center side, which are scanned by the laser beam scanning mechanisms 4A, 4B and 4C on the lower left side, the lower right side and the upper center side, from being emitted directly to the outside through the projection lens 200.

In addition, in the illumination device 1E of the embodiment, the laser beam scanning mechanisms 4A and 4B on the lower left side and the lower right side are located at positions corresponding to the lower side of the short side direction of the light distribution pattern with respect to the wavelength conversion member 3, and the laser beam scanning mechanism 4C on an upper center side is located at a position corresponding to the upper side of the short side direction of the light distribution pattern with respect to the wavelength conversion member 3. Furthermore, the laser beam scanning mechanisms 4A and 4B on the lower left side and the lower right side are disposed to be deviated to one side corresponding to the left side in the longitudinal direction of the light distribution pattern and the other side corresponding to the right side in the longitudinal direction of the light distribution pattern, respectively. The laser beam scanning mechanisms 4A and 4B of the illumination device 1E on the embodiment are disposed on one side corresponding to the left side in the longitudinal direction of the light distribution pattern and the other side corresponding to the right side in the longitudinal direction of the light distribution pattern, respectively, so as to be deviated with respect to the center of the wavelength conversion member 3.

Further, in the illumination device 1E of the embodiment, when the wavelength conversion member 3 is seen in a plan view, the center P1 of the scanning range S1 of the laser beam BL1 on the lower left side and the center P2 of the scanning range S2 of the laser beam BL2 on the lower right side are located on the left side and the right side with the center O of the laser beam irradiation region E sandwiched therebetween.

Accordingly, in the vehicle lamp 100 including the illumination device 1E of the embodiment, it is possible to reduce spot sizes of the laser beams BL1, BL2 and BL3 on the lower left side, the lower right side and the upper center side radiated to the wavelength conversion member 3. As a result, it is possible to increase resolution of the light distribution pattern formed by the above-mentioned ADB.

Fifth Embodiment

Next, as a fifth embodiment of the present invention, for example, the vehicle lamp 100 including an illumination device 1F shown in FIG. 14 and FIG. 15 will be described.

Figure 14:
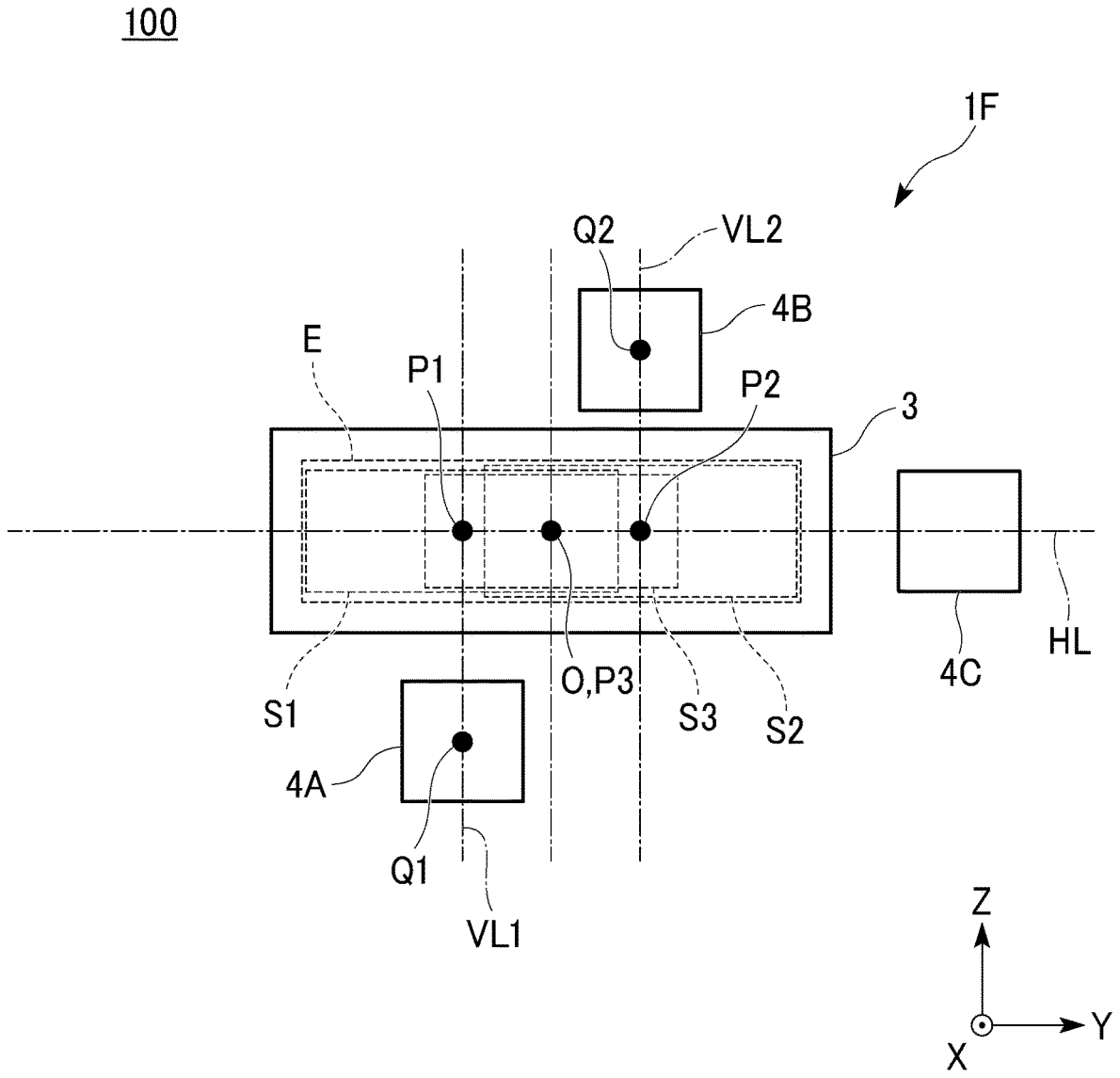
FIG. 14 is a schematic diagram showing a configuration of a vehicle lamp including an illumination device according to a fifth embodiment of the present invention.

Further, FIG. 14 is a schematic diagram showing a configuration of the vehicle lamp 100 including the illumination device 1F. FIG. 15 is a front view showing a positional relation between the center O of the laser beam irradiation region E of the illumination device 1F, the center P1 of the scanning range S1 of the laser beam BL1 on the lower left side, the center P2 of the scanning range S2 of the laser beam BL2 on the upper right side, and the center P3 of the scanning range S3 of the laser beam BL3 on the right side.

In addition, in the following description, the same parts as the illumination device 1C are designated by the same reference signs in the drawings and description thereof will be omitted. In addition, the transmission type wavelength conversion member 3A and the reflection type wavelength conversion member 3B are collectively treated as "the wavelength conversion member 3," and the present invention can also be applied similarly to the reflection type illumination device although the description is performed while exemplifying the transmission type illumination device 1F in FIG. 14 and FIG. 15.

Figure 15:
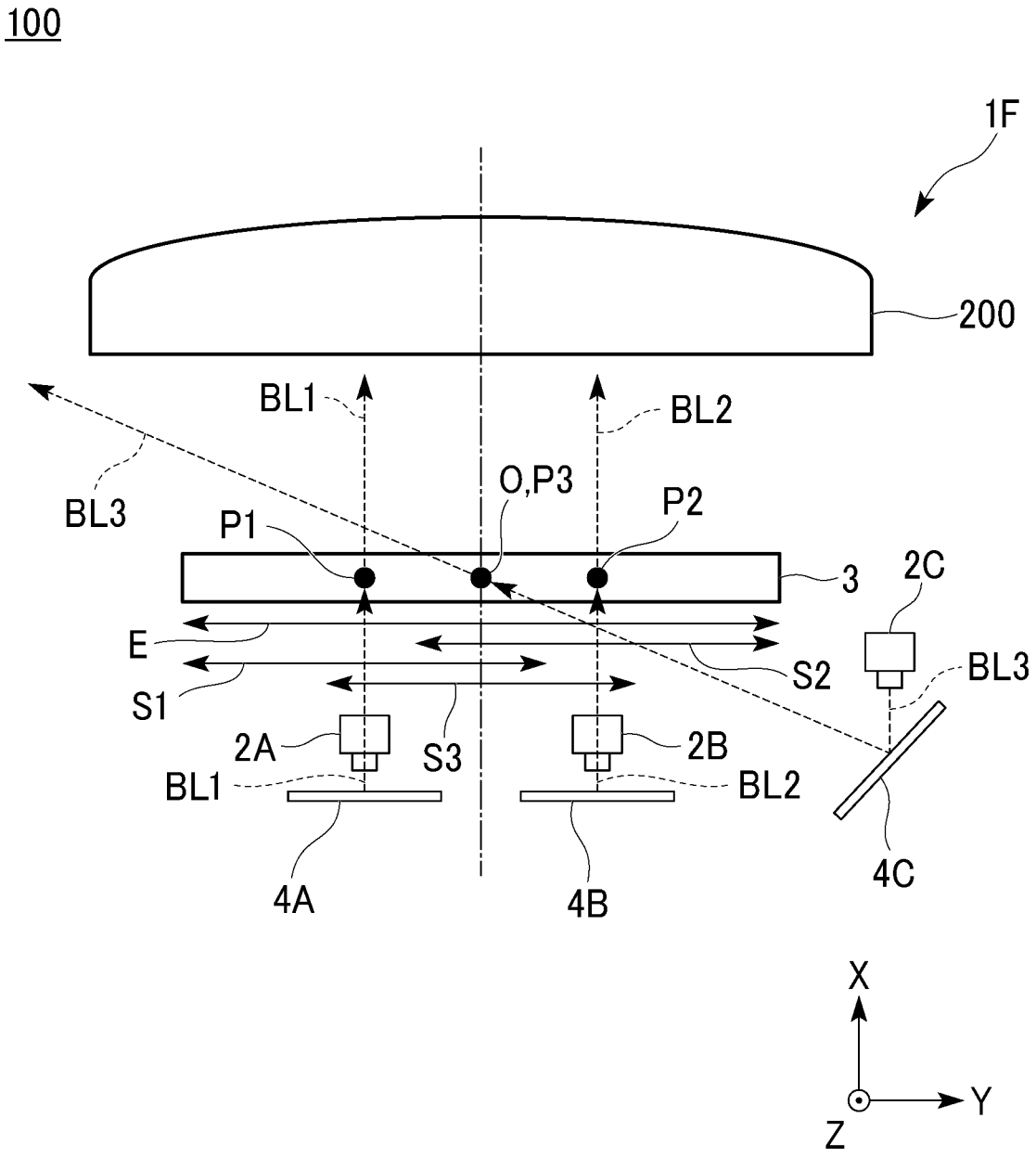
FIG. 15 is a front view showing a positional relation between a center of a laser beam irradiation region of the illumination device shown in FIG. 14, a center of a scanning range of a laser beam on a lower left side, a center of a scanning range of a laser beam on an upper right side, and a center of a scanning range of a laser beam on a right side.

As shown in FIG. 14 and FIG. 15, the vehicle lamp 100 including the illumination device 1F of the embodiment has the laser light source 2C and the laser beam scanning mechanism 4C on the right side additionally disposed on either one of the left side (one side) and the right side (the other side) (in the embodiment, the right side) in the longitudinal direction of the light distribution pattern with respect to the wavelength conversion member 3, in addition to the configuration of the illumination device 1C.

The laser beam scanning mechanism 4C on the right side forms a light distribution pattern according to the scanning range S3 of the laser beam BL3 on the right side by scanning the laser beam BL3 on the right side (additional) radiated toward the laser beam irradiation region E from the laser light source 2C on the right side.

In the illumination device 1F of the embodiment, one synthesis light distribution pattern is formed by overlapping the light distribution pattern according to the scanning range S1 of the laser beam BL1 on the lower left side, the light distribution pattern according to the scanning range S2 of the laser beam BL2 on the upper right side, and the light distribution pattern according to the scanning range S3 of the laser beam BL3 on the right side.

In addition, in the illumination device 1F of the embodiment, when the wavelength conversion member 3 is seen in a plan view, the center P3 of the scanning range S3 of the laser beam BL3 on the right side is located at a position that matches with the center O of the laser beam irradiation region E.

In the illumination device 1F of the embodiment having the above-mentioned configuration, incidence angles of the laser beams BL1, BL2 and BL3 on the lower left side, the upper right side and the right side, which are scanned by the laser beam scanning mechanisms 4A, 4B and 4C on the lower left side, the upper right side and the right side, with respect to the wavelength conversion member 3 are set to angles where the laser beams BL1, BL2 and BL3 do not directly enter the projection lens 200 when the wavelength conversion member 3 is damaged, chipped or fallen off.

Accordingly, in the vehicle lamp 100 including the illumination device 1F of the embodiment, even when flaws, damage, falling off, or the like occurs in the wavelength conversion member 3, it is possible to prevent the laser beams BL1, BL2 and BL3 on the lower left side, the upper right side and the right side, which are scanned by the laser beam scanning mechanisms 4A, 4B and 4C on the lower left side, the upper right side and the right side, from being emitted directly to the outside through the projection lens 200.

In addition, in the illumination device 1F of the embodiment, the laser beam scanning mechanisms 4A and 4B on the lower left side and the upper right side are located at positions corresponding to the lower side and the upper side in the short side direction of the light distribution pattern with respect to the wavelength conversion member 3, and furthermore, are disposed to be deviated to one side corresponding to the left side in the longitudinal direction of the light distribution pattern and the other side corresponding to the right side in the longitudinal direction of the light distribution pattern, respectively. The laser beam scanning mechanisms 4A and 4B of the illumination device 1F of the embodiment are disposed on one side corresponding to the left side in the longitudinal direction of the light distribution pattern and the other side corresponding to the right side in the longitudinal direction of the light distribution pattern, respectively, so as to be deviated with respect to the center of the wavelength conversion member 3.

Further, in the illumination device 1F of the embodiment, when the wavelength conversion member 3 is seen in a plan view, the center P1 of the scanning range S1 of the laser beam BL1 on the lower left side and the center P2 of the scanning range S2 of the laser beam BL2 on the upper right side are located on the left side and the right side with the center O of the laser beam irradiation region E sandwiched therebetween.

Accordingly, in the vehicle lamp 100 including the illumination device 1F of the embodiment, it is possible to reduce spot sizes of the laser beams BL1 and BL2 on the lower left side and the upper right side radiated to the wavelength conversion member 3. As a result, it is possible to increase resolution of the light distribution pattern formed by the above-mentioned ADB.

In addition, in the illumination device 1F of the embodiment, it is possible to reduce a spot size of the laser beam BL3 on the right side by reducing the scanning range S3 in the leftward/rightward direction of the laser beam BL3 on the right side radiated to the wavelength conversion member 3 to be smaller than the scanning ranges S1 and S2 in the leftward/rightward direction of the laser beams BL1 and BL2 on the lower left side and the upper right side radiated to the wavelength conversion member 3.

In addition, in the illumination device 1F of the embodiment, it is easier to spatially dispose the laser light source 2C and the laser beam scanning mechanism 4C, that are additionally disposed, than the illumination device 1E.

Sixth Embodiment

Next, as a sixth embodiment of the present invention, for example, the vehicle lamp 100 including an illumination device 1G shown in FIG. 16 and FIG. 17 will be described.

Figure 16:
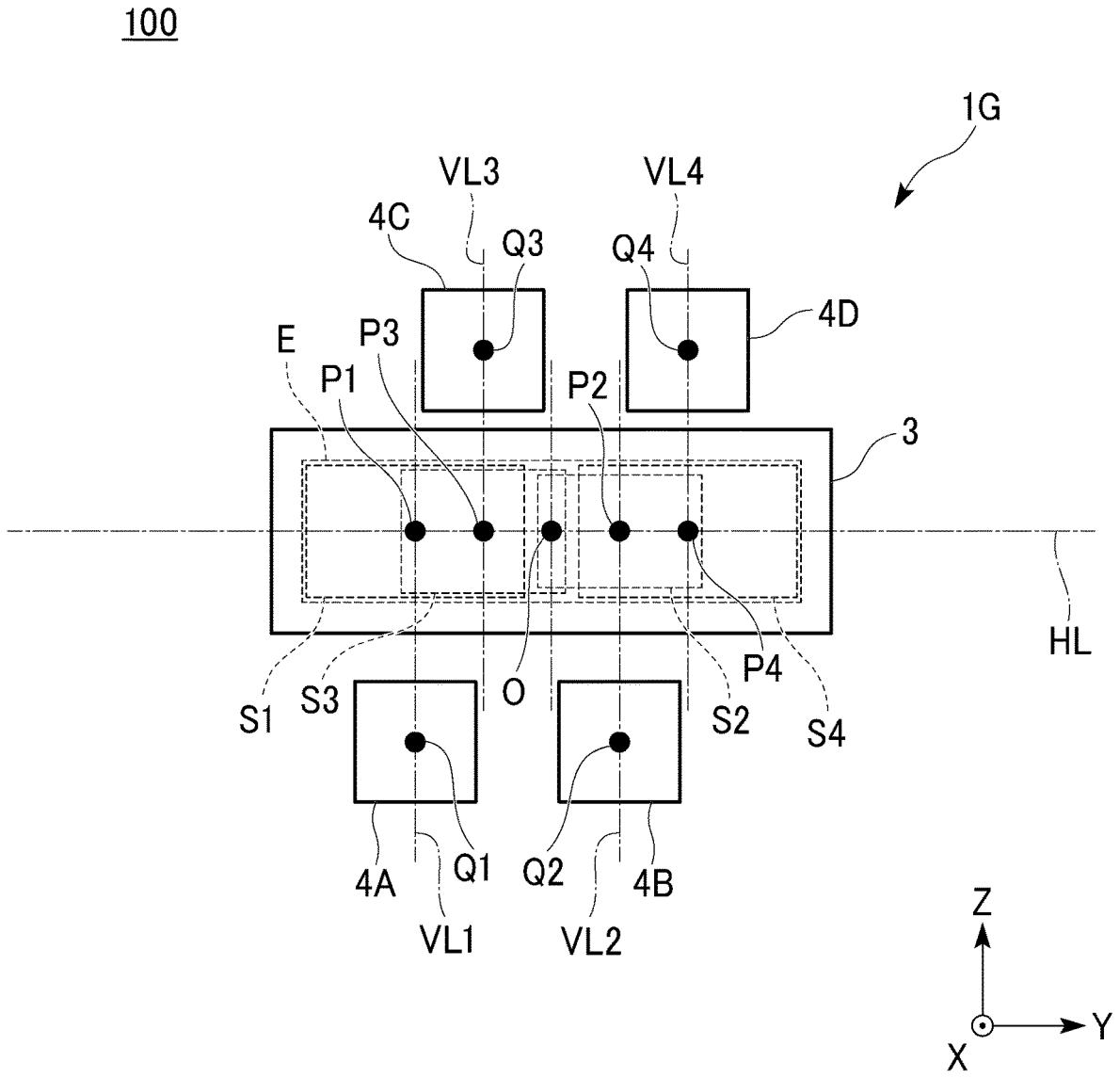
FIG. 16 is a schematic diagram showing a configuration of a vehicle lamp including an illumination device according to a sixth embodiment of the present invention.

Further, FIG. 16 is a schematic diagram showing a configuration of the vehicle lamp 100 including the illumination device 1G. FIG. 17 is a front view showing a positional relation between the center O of the laser beam irradiation region E of the illumination device 1C, the center P1 of the scanning range S1 of the laser beam BL1 on the lower left side, the center P2 of the scanning range S2 of the laser beam BL2 on the lower right side, the center P3 of the scanning range S3 of the laser beam BL3 on the upper left side, and the center P4 of the scanning range S4 of the laser beam BL4 on the upper right side.

In addition, in the following description, the same parts as the illumination device 1D are designated by the same reference signs in the drawings and description thereof will be omitted. In addition, the transmission type wavelength conversion member 3A and the reflection type wavelength conversion member 3B are collectively treated as "the wavelength conversion member 3," and the present invention can also be applied similarly to the reflection type illumination device although the description is performed while exemplifying the transmission type illumination device 1G in FIG. 16 and FIG. 17.

Figure 17:
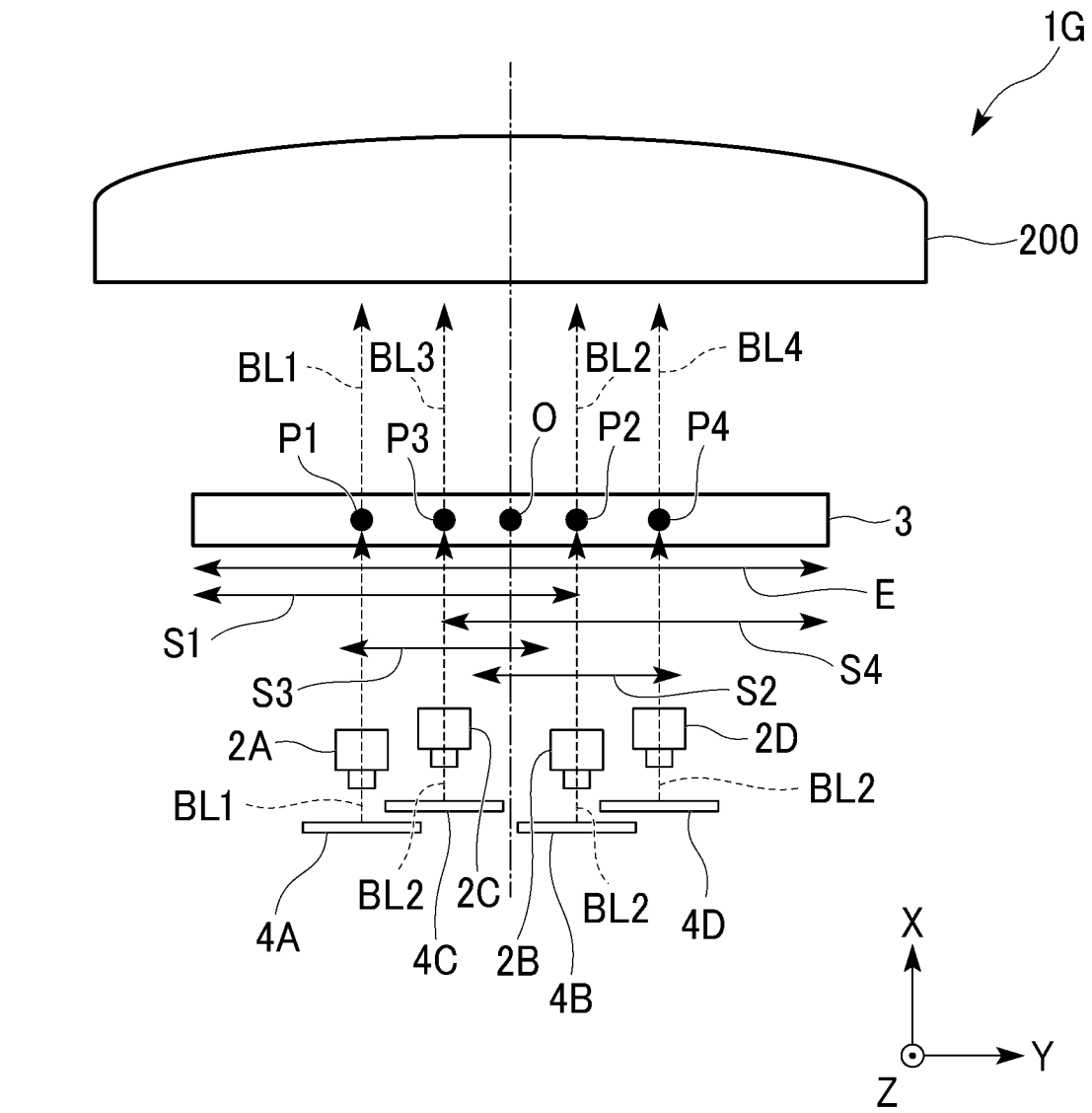
FIG. 17 is a front view showing a positional relation between a center of a laser beam irradiation region of the illumination device shown in FIG. 16, a center of a scanning range of a laser beam on a lower left side, a center of a scanning range of a laser beam on a lower right side, a center of a scanning range of a laser beam on an upper left side, and a center of a scanning range of a laser beam on an upper right side.

As shown in FIG. 16 and FIG. 17, in addition to the configuration of the illumination device 1D, the vehicle lamp 100 including the illumination device 1G of the embodiment has the laser light source 4C and the laser beam scanning mechanism 4C on the upper left side that are located at a position corresponding to the upper side in the short side direction of the light distribution pattern with respect to the wavelength conversion member 3 and that are disposed to be deviated to the left side (one side) in the longitudinal direction of the light distribution pattern, and the laser light source 4D and the laser beam scanning mechanism 4D on the upper right side that are located at a position corresponding to the upper side in the short side direction of the light distribution pattern with respect to the wavelength conversion member 3 and that are disposed to be deviated to the right side (the other side) in the longitudinal direction of the light distribution pattern. Other than that, basically the same configuration as the vehicle lamp 100 including the illumination device 1D is provided. The laser light source 4C and the laser beam scanning mechanism 4C of the vehicle lamp 100 including the illumination device 1G of the embodiment are disposed on the left side (one side) in the longitudinal direction of the light distribution pattern to be deviated with respect to the center of the wavelength conversion member 3. The laser light source 4D and the laser beam scanning mechanism 4D of the vehicle lamp 100 including the illumination device 1G of the embodiment are disposed on the right side (the other side) in the longitudinal direction of the light distribution pattern to be deviated with respect to the center of the wavelength conversion member 3.

The laser beam scanning mechanism 4C on the upper left side forms a light distribution pattern according to the scanning range S3 of the laser beam BL3 on the upper left side by scanning the laser beam BL3 on the upper left side (one side) radiated toward the laser beam irradiation region E from the laser light source 2C on the upper left side.

The laser beam scanning mechanism 4D on the upper right side forms a light distribution pattern according to the scanning range S2 of the laser beam BL2 on the upper right side by scanning the laser beam BL2 on the upper right side (the other side) radiated toward the laser beam irradiation region E from the laser light source 2D on the upper right side.

In the illumination device 1G of the embodiment, one synthesis light distribution pattern is formed by overlapping the light distribution pattern according to the scanning range S1 of the laser beam BL1 on the lower left side, the light distribution pattern according to the scanning range S2 of the laser beam BL2 on the lower right side, the light distribution pattern according to the scanning range S3 of the laser beam BL3 on the upper left side, and the light distribution pattern according to the scanning range S4 of the laser beam BL4 on the upper right side.

In addition, in the illumination device 1G of the embodiment, when the wavelength conversion member 3 is seen in a plan view, the center P3 of the scanning range S3 of the laser beam BL3 on the upper left side is located at an intersection between the vertical line VL3 corresponding to the upward/downward direction of the light distribution pattern passing through the center Q3 of the laser beam scanning mechanism 4C on the upper left side and the horizontal line HL corresponding to the leftward/rightward direction of the light distribution pattern passing through the center O of the laser beam irradiation region E. On the other hand, the center P4 of the scanning range S4 of the laser beam BL4 on the upper right side is located at an intersection between the vertical line VL4 corresponding to the upward/downward direction of the light distribution pattern passing through the center Q4 of the laser beam scanning mechanism 4D on the upper right side and the horizontal line HL corresponding to the leftward/rightward direction of the light distribution pattern passing through the center O of the laser beam irradiation region E.

Accordingly, in the illumination device 1G of the embodiment, when the wavelength conversion member 3 is seen in a plan view, the center P3 of the scanning range S3 of the laser beam BL3 on the upper left side and the center P4 of the scanning range S4 of the laser beam BL4 on the upper right side are located on the left side and the right side with the center O of the laser beam irradiation region E sandwiched therebetween.

In the illumination device 1G of the embodiment having the above-mentioned configuration, incidence angles of the laser beams BL3 and BL4 on the upper left side and the upper right side, which are scanned by the laser beam scanning mechanisms 4C and 4D on the upper left side and the upper right side, with respect to the wavelength conversion member 3 are set to angles where the laser beams BL3 and BL4 do not directly enter the projection lens 200 when the wavelength conversion member 3 is damaged, chipped or fallen off.

Accordingly, in the vehicle lamp 100 including the illumination device 1G of the embodiment, even when flaws, damage, falling off, or the like occurs in the wavelength conversion member 3, it is possible to prevent the laser beams BL3 and BL4 on the upper left side and the upper right side, which are scanned by the laser beam scanning mechanisms 4C and 4D on the upper left side and the upper right side, from being emitted directly to the outside through the projection lens 200.

In addition, in the illumination device 1G of the embodiment, the laser beam scanning mechanisms 4C and 4D on the upper left side and the upper right side are located at positions corresponding to the upper side in the short side direction of the light distribution pattern with respect to the wavelength conversion member 3, and furthermore, are disposed to be deviated to one side corresponding to the left side in the longitudinal direction of the light distribution pattern and the other side corresponding to the right side in the longitudinal direction of the light distribution pattern, respectively. The laser beam scanning mechanisms 4C and 4D of the illumination device 1G of the embodiment are disposed on the one side corresponding to the left side in the longitudinal direction of the light distribution pattern and the other side corresponding to the right side in the longitudinal direction of the light distribution pattern, respectively, so as to be deviated with respect to the center of the wavelength conversion member 3.

Further, in the illumination device 1G of the embodiment, when the wavelength conversion member 3 is seen in a plan view, the center P3 of the scanning range S3 of the laser beam BL3 on the upper left side and the center P4 of the scanning range S4 of the laser beam BL4 on the upper right side are located on the left side and the right side with the center O of the laser beam irradiation region E sandwiched therebetween.

Accordingly, in the vehicle lamp 100 including the illumination device 1G of the embodiment, it is possible to reduce spot sizes of the laser beams BL3 and BL4 on the upper left side and the upper right side radiated to the wavelength conversion member 3. As a result, it is possible to increase resolution of the light distribution pattern formed by the above-mentioned ADB.

Seventh Embodiment

Next, as a seventh embodiment of the present invention, for example, the vehicle lamp 100 including an illumination device 1H shown in FIG. 18 and FIG. 19 will be described.

Figure 18:
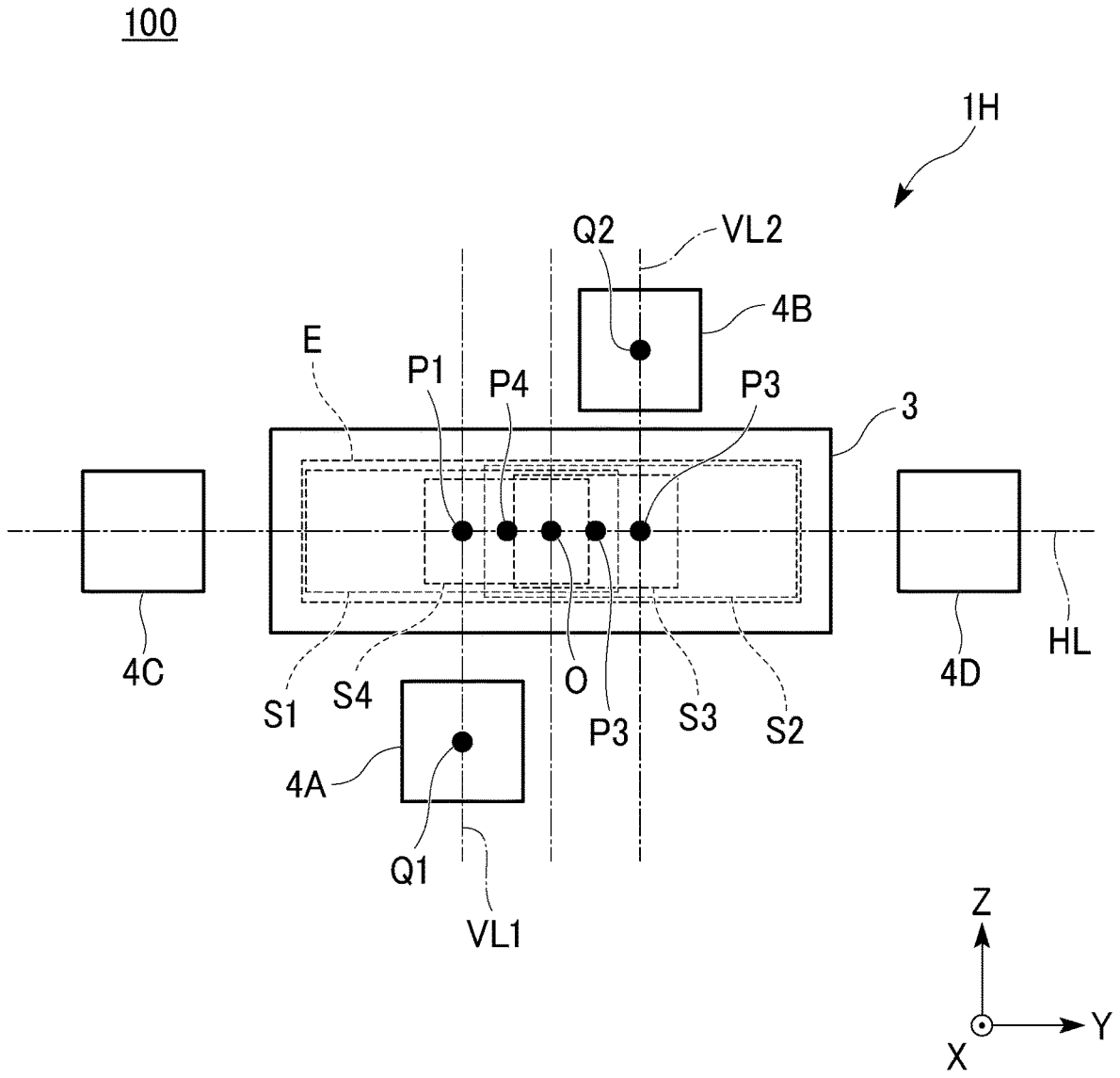
FIG. 18 is a schematic diagram showing a configuration of a vehicle lamp including an illumination device according to a seventh embodiment of the present invention.

Further, FIG. 18 is a schematic diagram showing a configuration of the vehicle lamp 100 including the illumination device 1H. FIG. 19 is a front view showing a positional relation between the center O of the laser beam irradiation region E of the illumination device 1H, the center P1 of the scanning range S1 of the laser beam BL1 on the lower left side, the center P2 of the scanning range S2 of the laser beam BL2 on the upper right side, the center P3 of the scanning range S3 of the laser beam BL3 on the left side, and the center P4 of the scanning range S4 of the laser beam BL4 on the right side.

In addition, in the following description, the same parts as the illumination device 1C are designated by the same reference signs in the drawings and description thereof will be omitted. In addition, the transmission type wavelength conversion member 3A and the reflection type wavelength conversion member 3B are collectively treated as "the wavelength conversion member 3," and the present invention can also be applied similarly to the reflection type illumination device although the description is performed while exemplifying the transmission type illumination device 1F in FIG. 18 and FIG. 19.

Figure 19:
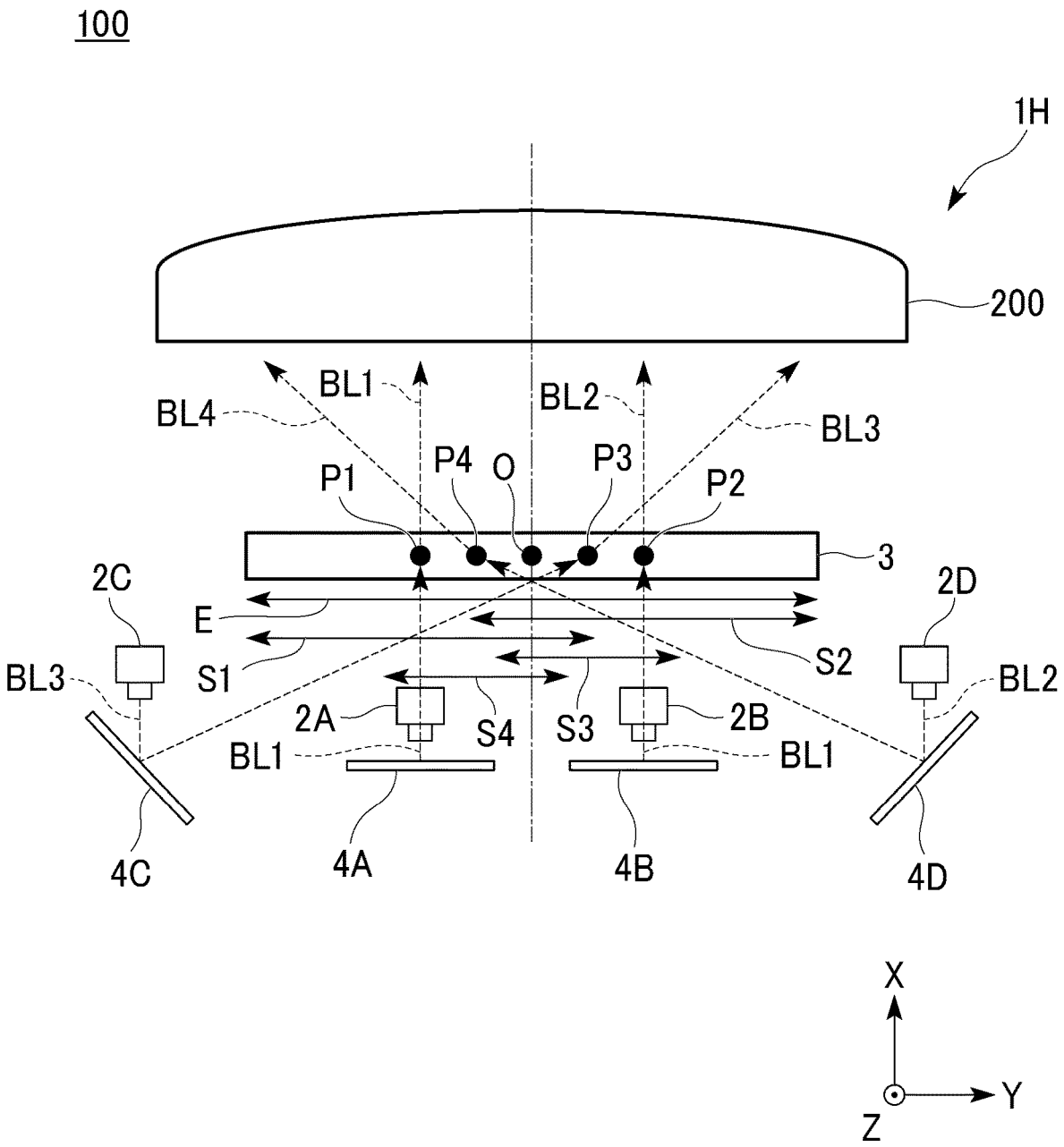
FIG. 19 is a front view showing a positional relation between a center of a laser beam irradiation region of the illumination device shown in FIG. 18, a center of a scanning range of a laser beam on a lower left side, a center of a scanning range of a laser beam on an upper right side, a center of a scanning range of a laser beam on a left side, and a center of a scanning range of a laser beam on a right side.

As shown in FIG. 18 and FIG. 19, in addition to the configuration of the illumination device 1C, the vehicle lamp 100 including the illumination device 1H of the embodiment has the laser light source 2C and the laser beam scanning mechanism 4C on the left side that are disposed on the left side (one side) in the longitudinal direction of the light distribution pattern with respect to the wavelength conversion member 3, and the laser light source 2D and the laser beam scanning mechanism 4D on the right side that are disposed on the right side (the other side) in the longitudinal direction of the light distribution pattern with respect to the wavelength conversion member 3.

The laser beam scanning mechanism 4C on the left side forms a light distribution pattern according to the scanning range S3 of the laser beam BL3 on the left side by scanning the laser beam BL3 on the left side (additional) radiated toward the laser beam irradiation region E from the laser light source 2C on the left side.

The laser beam scanning mechanism 4D on the right side forms a light distribution pattern according to the scanning range S4 of the laser beam BL4 on the right side by scanning the laser beam BL4 on the right side (additional) radiated toward the laser beam irradiation region E from the laser light source 2D on the right side.

In the illumination device 1H of the embodiment, one synthesis light distribution pattern is formed by overlapping the light distribution pattern according to the scanning range S1 of the laser beam BL1 on the lower left side, the light distribution pattern according to the scanning range S2 of the laser beam BL2 on the upper right side, the light distribution pattern according to the scanning range S3 of the laser beam BL3 on the left side, and the light distribution pattern according to the scanning range S4 of the laser beam BL4 on the right side.

In addition, in the illumination device 1H of the embodiment, when the wavelength conversion member 3 is seen in a plan view, the center P3 of the scanning range S3 of the laser beam BL3 on the left side is located at a side (right side) opposite to a side where the laser beam scanning mechanism 4C is disposed on the left side with respect to the center O of the laser beam irradiation region E. On the other hand, the center P4 of the scanning range S4 of the laser beam BL4 on the right side is located at a side (left side) opposite to a side where the laser beam scanning mechanism 4D is disposed on the right side with respect to the center O of the laser beam irradiation region E.

In the illumination device 1H of the embodiment having the above-mentioned configuration, incidence angles of the laser beams BL3 and BL4 on the left side and the right side, which are scanned by the laser beam scanning mechanisms 4C and 4D on the left side and the right side, with respect to the wavelength conversion member 3 are set to angles where the laser beams BL3 and BL4 do not directly enter the projection lens 200 when the wavelength conversion member 3 is damaged, chipped or fallen off.

Accordingly, in the vehicle lamp 100 including the illumination device 1H of the embodiment, even when flaws, damage, falling off, or the like occurs in the wavelength conversion member 3, it is possible to prevent the laser beams BL3 and BL4 on the left side and the right side, which are scanned by the laser beam scanning mechanisms 4C and 4D on the left side and the right side, from being emitted directly to the outside through the projection lens 200.

In addition, in the illumination device 1H of the embodiment, it is possible to reduce spot sizes of the laser beams BL3 and BL4 radiated to the wavelength conversion member 3 by locating the centers P3 and P4 of the scanning ranges S3 and S4 of the laser beams BL3 and BL4 on the left side and the right side at a side opposite to a side where the laser beam scanning mechanisms 4C and 4D are disposed on the left side and the right side with respect to the center O of the laser beam irradiation region E. Accordingly, it is possible to increase resolution of the light distribution pattern formed by the above-mentioned ADB.

In addition, in the illumination device 1H of the embodiment, it is possible to reduce spot sizes of the laser beams BL3 and BL4 on the left side and the right side by reducing the scanning ranges S3 and S4 in the leftward/rightward direction of the laser beams BL3 and BL4 on the left side and the right side radiated to the wavelength conversion member 3 to be smaller than the scanning ranges S1 and S2 in the leftward/rightward direction of the laser beams BL1 and BL2 on the lower left side and the upper right side radiated to the wavelength conversion member 3.

In addition, in the illumination device 1H of the embodiment, it is easier to spatially dispose the laser light sources 2C and 2D and the laser beam scanning mechanisms 4C and 4D, which are additionally disposed, than the above-mentioned illumination device 1G.

EXAMPLES

Hereinafter, effects of the present invention are made clearer by the examples. Further, the present invention is not limited to the following examples, and can be appropriately modified and implemented without departing from the scope of the present invention.

Figure 20:
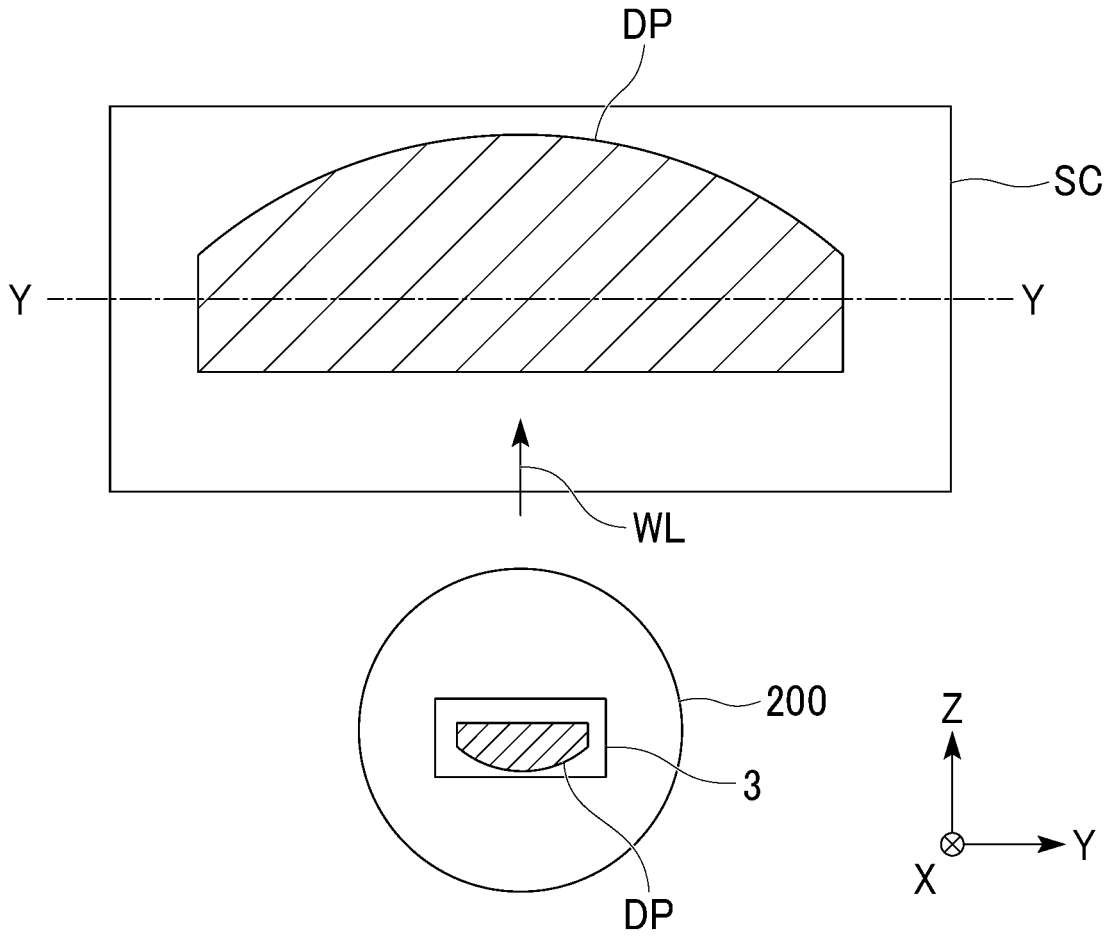
FIG. 20 is a schematic diagram showing a state in which a light source image of a light distribution pattern formed in a surface of a wavelength conversion member is projected to a virtual vertical screen facing the illumination device.

In the examples, as shown in FIG. 20, simulation of radiating the illumination light WL toward the side in front of the illumination device using the projection lens 200 and projecting a light source image of a light distribution pattern DP formed in the surface of the wavelength conversion member 3 to a virtual vertical screen SC facing the illumination device was performed using the illumination devices of Examples 1-1 and 1-2 and Comparative example 1, Examples 2-1 and 2-2 and Comparative example 2, Examples 3-1 and 3-2 and Comparative example 3, and Examples 4-1 and 4-2 and Comparative example 4.

Figure 21:
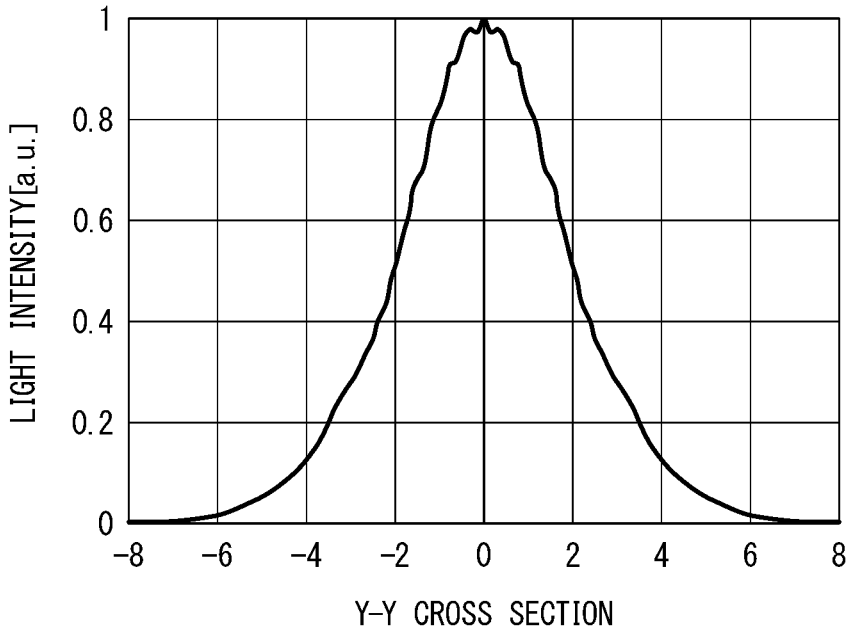
FIG. 21 is a graph showing a light intensity distribution in a cross section of a light distribution pattern along a line segment Y-Y shown in FIG. 20.

In addition, in a cross section of the light distribution pattern DP along a line segment Y-Y shown in FIG. 20 (a cross section in a longitudinal direction of the light distribution pattern DP), the illumination light WL radiated from each of the illumination devices was adjusted to satisfy a light intensity distribution of a light distribution pattern for a high beam as shown in FIG. 21.

Examples 1-1 and 1-2 and Comparative Example 1

In Example 1-1, a transmission type illumination device corresponding to the illumination device 1E was used. In addition, among the laser beam scanning mechanisms 4A, 4B and 4C on the lower left side, the lower right side and the upper center side, the lower left side was referred to as "MEMS 1," the lower right side was referred to as "MEMS 2," and the upper center side was referred to as "MEMS 3," the scanning ranges S1 to S3 of the laser beams BL1 to BL3 by these three of MEMS 1 to MEMS 3 and the centers P1 to P3 thereof were adjusted as shown in the following Table 1, and the light distribution pattern DP that satisfies the light intensity distribution of the light distribution pattern for a high beam as shown in FIG. 21 was formed by overlapping the light distribution patterns according to the scanning ranges S1 to S3 of each of the laser beams BL1 to BL3.

TABLE 1

| | MEMS 1 | MEMS 2 | MEMS 3 |
|---|---|---|---|
| Center of scanning range [mm] | −2.24 | 2.24 | 0 |
| Scanning width [mm] | 11.52 | 11.52 | 4.32 |

Further, in Table 1, in the centers P1 to P3 of the scanning ranges S1 to S3, the center O of the laser beam irradiation region E on the horizontal line HL is set as 0 [mm], the left side with respect to the center O of the laser beam irradiation region E is represented as a negative (−) side, and the right side is represented as a positive (+) side. In addition, the scanning ranges S1 to S3 are scanning widths on the horizontal line HL. In addition, Table 2 to Table 12 as described below are represented similarly.

In Example 1-2, a transmission type illumination device corresponding to the illumination device 1F was used. In addition, among the laser beam scanning mechanisms 4A, 4B and 4C on the lower left side, the upper right side and the right side, the lower left side was referred to as "MEMS 1," the upper right side was referred to as "MEMS 2," and the right side was referred to as "MEMS 3," the scanning ranges S1 to S3 of the laser beams BL1 to BL3 by these three of MEMS 1 to MEMS 3 and the centers P1 to P3 thereof were adjusted as shown in the following Table 2, and the light distribution pattern DP that satisfies the light intensity distribution of the light distribution pattern for a high beam as shown in FIG. 21 was formed by overlapping the light distribution patterns according to the scanning ranges S1 to S3 of each of the laser beams BL1 to BL3.

TABLE 2

| | MEMS 1 | MEMS 2 | MEMS 3 |
|---|---|---|---|
| Center of scanning range [mm] | −2.24 | 2.24 | 0 |
| Scanning width [mm] | 11.52 | 11.52 | 4.32 |

Meanwhile, in Comparative example 1, among the three of MEMS 1 to MEMS 3 that constitute the transmission type illumination device, "MEMS 1" was disposed on the left side, "MEMS 2 was disposed on the right side, and "MEMS 3" was disposed on the upper side with respect to the wavelength conversion member 3, the scanning ranges S1 to S3 of the laser beams BL1 to BL3 by these three of MEMS 1 to MEMS 3 and the centers P1 to P3 thereof were adjusted as shown in the following Table 3 and the light distribution pattern DP that satisfies the light intensity distribution of the light distribution pattern for a high beam as shown in FIG. 21 was formed by overlapping the light distribution patterns according to the scanning ranges S1 to S3 of each of the laser beams BL1 to BL3.

TABLE 3

| | MEMS 1 | MEMS 2 | MEMS 3 |
|---|---|---|---|
| Center of scanning range [mm] | 0 | 0 | 0 |
| Scanning width [mm] | 8 | 4.32 | 16 |

Examples 2-1 and 2-2 and Comparative Example 2

In Example 2-1, a reflection type illumination device corresponding to the illumination device 1E was used. In addition, among the laser beam scanning mechanisms 4A, 4B and 4C on the lower left side, the lower right side and the upper center side, the lower left side is referred to as "MEMS 1," the lower right side is referred to as "MEMS 2," and the upper center side is referred to as "MEMS 3," the scanning ranges S1 to S3 of the laser beams BL1 to BL3 by these three of MEMS 1 to MEMS 3 and the centers P1 to P3 thereof were adjusted as shown in the following Table 4 and the light distribution pattern DP that satisfies the light intensity distribution of the light distribution pattern for a high beam as shown in FIG. 21 was formed by overlapping the light distribution patterns according to the scanning ranges S1 to S3 of each of the laser beams BL1 to BL3.

TABLE 4

| | MEMS 1 | MEMS 2 | MEMS 3 |
|---|---|---|---|
| Center of scanning range [mm] | −2.24 | 2.24 | 0 |
| Scanning width [mm] | 11.52 | 11.52 | 4.32 |

In Example 2-2, a reflection type illumination device corresponding to the illumination device 1F was used. In addition, among the laser beam scanning mechanisms 4A, 4B and 4C on the lower left side, the upper right side and the right side, the lower left side is referred to as "MEMS 1," the upper right side is referred to as "MEMS 2," and the right side is referred to as "MEMS 3," the scanning ranges S1 to S3 of the laser beams BL1 to BL3 by these three of MEMS 1 to MEMS 3 and the centers P1 to P3 thereof were adjusted as shown in the following Table 5 and the light distribution pattern DP that satisfies the light intensity distribution of the light distribution pattern for a high beam as shown in FIG. 21 was formed by overlapping the light distribution patterns according to the scanning ranges S1 to S3 of each of the laser beams BL1 to BL3.

TABLE 5

| | MEMS 1 | MEMS 2 | MEMS 3 |
|---|---|---|---|
| Center of scanning range [mm] | −2.24 | 2.24 | 0 |
| Scanning width [mm] | 11.52 | 11.52 | 4.32 |

Meanwhile, in Comparative example 2, in the three of MEMS 1 to MEMS 3 that constitute the reflection type illumination device, "MEMS 1" was disposed on the left side, "MEMS 2" was disposed on the right side, and "MEMS 3" was disposed on the upper side with respect to the wavelength conversion member 3, the scanning ranges S1 to S3 of the laser beams BL1 to BL3 by these three of MEMS 1 to MEMS 3 and the centers P1 to P3 thereof were adjusted as shown in the following Table 6 and the light distribution pattern DP that satisfies the light intensity distribution of the light distribution pattern for a high beam as shown in FIG. 21 was formed by overlapping the light distribution patterns according to the scanning ranges S1 to S3 of each of the laser beams BL1 to BL3.

TABLE 6

| | MEMS 1 | MEMS 2 | MEMS 3 |
|---|---|---|---|
| Center of scanning range [mm] | 0 | 0 | 0 |
| Scanning width [mm] | 8 | 4.32 | 16 |

Examples 3-1 and 3-2 and Comparative Example 3

In Example 3-1, a transmission type illumination device corresponding to the illumination device 1G was used. In addition, among the laser beam scanning mechanisms 4A, 4B, 4C and 4D on the lower left side, the lower right side, the upper left side and the lower right side, the lower left side was referred to as "MEMS 1," the lower right side was referred to as "MEMS 2," the upper left side was referred to as "MEMS 3," and the upper right side was referred to as "MEMS 4," the scanning ranges S1 to S4 of the laser beams BL1 to BL4 by these four of MEMS 1 to MEMS 4 and the centers P1 to P4 thereof were adjusted as shown in the following Table 7 and the light distribution pattern DP that satisfies the light intensity distribution of the light distribution pattern for a high beam as shown in FIG. 21 was formed by overlapping the light distribution patterns according to the scanning ranges S1 to S4 of each of the laser beams BL1 to BL4.

TABLE 7

| | MEMS 1 | MEMS 2 | MEMS 3 | MEMS 4 |
|---|---|---|---|---|
| Center of scanning range [mm] | −2.08 | 0.68 | −0.68 | 2.08 |
| Scanning width [mm] | 11.84 | 4.56 | 4.56 | 11.84 |

In Example 3-2, a transmission type illumination device corresponding to the illumination device 1H was used. In addition, among the laser beam scanning mechanisms 4A, 4B, 4C and 4D on the lower left side, the upper right side, the left side and the right side, the lower left side was referred to as "MEMS 1," the upper right side was referred to as "MEMS 2," the left side was referred to as "MEMS 3," and the right side was referred to as "MEMS 4," the scanning ranges S1 to S4 of the laser beams BL1 to BL4 by these four of MEMS 1 to MEMS 4 and the centers P1 to P4 thereof were adjusted as shown in the following Table 8 and the light distribution pattern DP that satisfies the light intensity distribution of the light distribution pattern for a high beam as shown in FIG. 21 was formed by overlapping the light distribution patterns according to the scanning ranges S1 to S4 of each of the laser beams BL1 to BL4.

TABLE 8

| | MEMS 1 | MEMS 2 | MEMS 3 | MEMS 4 |
|---|---|---|---|---|
| Center of scanning range [mm] | −2.08 | 2.08 | 0.68 | −0.68 |
| Scanning width [mm] | 11.84 | 11.84 | 4.56 | 4.56 |

Meanwhile, in Comparative example 3, among the four of MEMS 1 to MEMS 4 that constitute the transmission type illumination device, "MEMS 1" was disposed on the left side, "MEMS 2" was disposed on the right side, "MEMS 3" was disposed on the upper side, and "MEMS 4" was disposed on the lower side, the scanning ranges S1 to S4 of the laser beams BL1 to BL4 by these four of MEMS 1 to MEMS 4 and the centers P1 to P4 thereof were adjusted as shown in the following Table 9 and the light distribution pattern DP that satisfies the light intensity distribution of the light distribution pattern for a high beam as shown in FIG. 21 was formed by overlapping the light distribution patterns according to the scanning ranges S1 to S4 of each of the laser beams BL1 to BL4.

TABLE 9

| | MEMS 1 | MEMS 2 | MEMS 3 | MEMS 4 |
|---|---|---|---|---|
| Center of scanning range [mm] | 0 | 0 | 0 | 0 |
| Scanning width [mm] | 3.68 | 5.76 | 8.48 | 16 |

Examples 4-1 and 4-2 and Comparative Example 4

In Example 4-1, a reflection type illumination device corresponding to the illumination device 1G was used. In addition, among the laser beam scanning mechanisms 4A, 4B, 4C and 4D on the lower left side, the lower right side, the upper left side and the lower right side, the lower left side is referred to as "MEMS 1," the lower right side is referred to as "MEMS 2," the upper left side is referred to as "MEMS 3," and upper right side is referred to as "MEMS 4," the scanning ranges S1 to S4 of the laser beams BL1 to BL4 by these four of MEMS 1 to MEMS 4 and the centers P1 to P4 thereof were adjusted as shown in the following Table 10 and the light distribution pattern DP that satisfies the light intensity distribution of the light distribution pattern for a high beam as shown in FIG. 21 was formed by overlapping the light distribution patterns according to the scanning ranges S1 to S4 of each of the laser beams BL1 to BL4.

TABLE 10

| | MEMS 1 | MEMS 2 | MEMS 3 | MEMS 4 |
|---|---|---|---|---|
| Center of scanning range [mm] | −2.08 | 0.68 | −0.68 | 2.08 |
| Scanning width [mm] | 11.84 | 4.56 | 4.56 | 11.84 |

In Example 4-2, a reflection type illumination device corresponding to the illumination device 1H was used. In addition, in the laser beam scanning mechanisms 4A, 4B, 4C and 4D on the lower left side, the upper right side, the left side and the right side, the lower left side is referred to as "MEMS 1," the upper right side is referred to as "MEMS 2," the left side is referred to as "MEMS 3," and the right side is referred to as "MEMS 4," the scanning ranges S1 to S4 of the laser beams BL1 to BL4 by these four of MEMS 1 to MEMS 4 and the centers P1 to P4 thereof were adjusted as shown in the following Table 11 and the light distribution pattern DP that satisfies the light intensity distribution of the light distribution pattern for a high beam as shown in FIG. 21 was formed by overlapping the light distribution patterns according to the scanning ranges S1 to S4 of each of the laser beams BL1 to BL4.

TABLE 11

| | MEMS 1 | MEMS 2 | MEMS 3 | MEMS 4 |
|---|---|---|---|---|
| Center of scanning range [mm] | −2.08 | 2.08 | 0.68 | −0.68 |
| Scanning width [mm] | 11.84 | 11.84 | 4.56 | 4.56 |

Meanwhile, in Comparative example 4, among the four of MEMS 1 to MEMS 4 that constitute the reflection type illumination device, "MEMS 1" is disposed on the left side, "MEMS 2" is disposed on the right side, "MEMS 3" is disposed on the upper side, and "MEMS 4" is disposed on the lower side, the scanning ranges S1 to S4 of the laser beams BL1 to BL4 by these four of MEMS 1 to MEMS 4 and the centers P1 to P4 thereof were adjusted as shown in the following Table 12 and the light distribution pattern DP that satisfies the light intensity distribution of the light distribution pattern for a high beam as shown in FIG. 21 was formed by overlapping the light distribution patterns according to the scanning ranges S1 to S4 of each of the laser beams BL1 to BL4.

TABLE 12

| | MEMS 1 | MEMS 2 | MEMS 3 | MEMS 4 |
|---|---|---|---|---|
| Center of scanning range [mm] | 0 | 0 | 0 | 0 |
| Scanning width [mm] | 3.68 | 5.76 | 8.48 | 16 |

In the examples, in the above-mentioned illumination devices of Examples 1-1 and 1-2 and Comparative example 1, Examples 2-1 and 2-2 and Comparative example 2, Examples 3-1 and 3-2 and Comparative example 3, and Examples 4-1 and 4-2 and Comparative example 4, incidence angles [° ] of the laser beams BL1 to BL3 (BL4) entering the center O of the laser beam irradiation region E from each of the MEMS 1 to MEMS 3 (MEMS 4) were calculated, and a maximum value (MAX) of the incidence angles were obtained. The results are summarized in the following Table 13.

TABLE 13

| | | Incident angle of laser beam BL1 to center O of region E from MEMS 1 [°] | Incident angle of laser beam BL2 to center O of region E from MEMS 2 [°] | Incident angle of laser beam BL3 to center O of region E from MEMS 3 [°] | Incident angle of laser beam BL4 to center O of region E from MEMS 4 [°] | Incident angle (MAX) [°] |
|---|---|---|---|---|---|---|
| Transmission type 3 MEMS | Example 1-1 | 54.2 | 54.2 | 54.2 | — | 54.2 |
| | Example 1-2 | 53.8 | 53.8 | 54.6 | — | 54.6 |
| | Comparative example 1 | 54.2 | 58.7 | 54.6 | — | 58.7 |
| Reflection type 3 MEMS | Example 2-1 | 54.2 | 54.2 | 54.2 | — | 54.2 |
| | Example 2-2 | 53.8 | 53.8 | 54.6 | — | 54.6 |
| | Comparative example 2 | 54.2 | 58.7 | 54.6 | — | 58.7 |
| Transmission type 4 MEMS | Example 3-1 | 53.9 | 54.1 | 54.1 | 53.9 | 54.1 |
| | Example 3-2 | 53.9 | 53.9 | 53.1 | 53.1 | 53.9 |
| | Comparative example 3 | 53.7 | 56.3 | 54.2 | 54.2 | 56.3 |
| Reflection type 4 MEMS | Example 4-1 | 53.9 | 54.1 | 54.1 | 53.9 | 54.1 |
| | Example 4-2 | 53.9 | 53.9 | 53.1 | 53.1 | 53.9 |
| | Comparative example 4 | 53.7 | 56.3 | 54.2 | 54.2 | 56.3 |

In addition, in the examples, in the above mentioned illumination devices of Examples 1-1 and 1-2 and Comparative example 1, Examples 2-1 and 2-2 and Comparative example 2, Examples 3-1 and 3-2 and Comparative example 3, and Examples 4-1 and 4-2 and Comparative example 4, spot sizes of the laser beams BL1 to BL3 (BL4) entering the center O of the laser beam irradiation region E from each of the MEMS 1 to MEMS 3 (MEMS 4) were calculated, ratios with respect to the spot sizes when the incidence angle is 0° (incident ratios) were obtained, and further, a maximum value (MAX) of the incidence rations was obtained. The results are summarized in the following Table 14.

TABLE 14

| | | Spot size of laser beam BL1 to center O of region E from MEMS 1 [0° Incident ratio] | Spot size of laser beam BL2 to center O of region E from MEMS 2 [0° Incident ratio] | Spot size of laser beam BL3 to center O of region E from MEMS 3 [0° Incident ratio] | Spot size of laser beam BL4 to center O of region E from MEMS 4 [0° Incident ratio] | Spot size (MAX) [0° Incident ratio] |
|---|---|---|---|---|---|---|
| Transmission type 3 MEMS | Example 1-1 | 1.71 | 1.71 | 1.71 | — | 1.71 |
| | Example 1-2 | 1.69 | 1.69 | 1.72 | — | 1.72 |
| | Comparative example 1 | 1.92 | 1.72 | 1.71 | — | 1.92 |
| Reflection type 3 MEMS | Example 2-1 | 1.71 | 1.71 | 1.71 | — | 1.71 |
| | Example 2-2 | 1.69 | 1.69 | 1.72 | — | 1.72 |
| | Comparative example 2 | 1.92 | 1.72 | 1.71 | — | 1.92 |
| Transmission type 4 MEMS | Example 3-1 | 1.70 | 1.71 | 1.71 | 1.70 | 1.71 |
| | Example 3-2 | 1.70 | 1.70 | 1.67 | 1.67 | 1.70 |
| | Comparative example 3 | 1.69 | 1.80 | 1.71 | 1.71 | 1.80 |
| Reflection type 4 MEMS | Example 4-1 | 1.70 | 1.71 | 1.71 | 1.70 | 1.71 |
| | Example 4-2 | 1.70 | 1.70 | 1.67 | 1.67 | 1.70 |
| | Comparative example 4 | 1.69 | 1.80 | 1.71 | 1.71 | 1.80 |

As shown in Table 13 and Table 14, in comparison with the illumination devices of Comparative examples 1, 2, 3 and 4, the illumination devices of Examples 1-1, 1-2, 2-1, 2-2, 3-1, 3-2, 4-1 and 4-2 can reduce the incidence angles and the spot sizes of the laser beams BL1 to BL3 (BL4) entering the center O of the laser beam irradiation region E from each of the MEMS 1 to MEMS 3 (MEMS 4).

Further, the present invention is not particularly limited to the embodiments, and various modifications may be made without departing from the scope of the present invention.

Specifically, in the illumination devices 1A to 1H, when the wavelength conversion members 3A and 3B are damaged, chipped or fallen off, since it is set to an angle where the laser beam BL does not directly enter the projection lens 200, a light absorbing section or a light shielding section configured to absorb or shield the laser beam BL scanned by the laser beam scanning mechanism 4 is preferably provided inside the lighting body. As the light absorbing section or the light shielding section, a configuration in which a light absorbing member or a light shielding member configured to absorb or shield the laser beam BL is disposed may be provided.

The wavelength conversion members 3A and 3B are not particularly limited to the above-mentioned embodiments, and configurations, materials, or the like, thereof may be appropriately selected and used.

For example, [1] as the wavelength conversion members 3A and 3B, a member obtained by joining or attaching a molded body of a phosphor plate to a substrate, or [2] a member obtained by forming a phosphor layer (wavelength conversion layer) on a substrate may be used.

In addition, in the case of the transmission type wavelength conversion member 3A, a transparent substrate such as a transparent ceramic substrate, a glass substrate, or the like, may be used. Meanwhile, in the case of the reflection type wavelength conversion member 3B, a reflection substrate obtained by forming a reflection film on a surface such as a ceramic substrate, a glass substrate, or the like, in addition to a metal substrate, may be used.

In the case of the above-mentioned [1], for example, a single crystal phosphor sheet, a phosphor ceramic sheet, a phosphor-dispersed glass sheet, a phosphor-dispersed resin sheet, or the like, may be used. In addition, as an adhesive agent, for example, a transparent adhesive agent such as an organic-based adhesive agent, an inorganic-based adhesive agent, or the like, is used.

Meanwhile, in the case of the above-mentioned [2], for example, a ceramic binder, a glass binder, or a resin binder in which phosphor particles are dispersed can be coated on a substrate using a dispense method, a rotary coating method, a printing method, a spray method, or the like.

As the phosphor particles, for example, phosphor oxide, phosphor nitride, phosphor oxynitride, phosphor sulfide, phosphor fluoride, or the like, may be granulated and used. Further, a thickness of a phosphor layer or a particle diameter (D50) of phosphor particles is not particularly limited and may be arbitrarily set. In addition, a transparent protective layer may be further provided on a phosphor layer. As the transparent protective layer, for example, an inorganic substance such as glass, ceramic, or the like, a silicon resin, an epoxy resin, or the like, may be used.

The laser beam scanning mechanism 4 may use a MEMS mirror of a piezoelectric type, an electrostatic type or an electromagnetic type. In addition, the MEMS mirror may use a biaxial type or two single axis types because the laser beam BL is scanned in the surfaces of the wavelength conversion members 3A and 3B.

In addition, as a biaxial type of a piezoelectric type, a single axis resonance/single axis non-resonance type, a biaxial resonance type, a biaxial non-resonance type, or the like, is exemplified. Further, in the case of the single axis resonance/single axis non-resonance type, a non-resonance axis and a resonance axis may be assigned to any one of an X axis and a Y axis in the surfaces of the wavelength conversion members 3A and 3B.

The reflector 5 is not limited to the above-mentioned planar mirror, and a curved mirror configured to correct distortion of the laser beam BL reflected toward the wavelength conversion members 3A and 3B may be used. In addition, a lens configured to correct distortion may also be disposed between the reflector 5 and the wavelength conversion members 3A and 3B.

The projection lens 200 is not limited to a single lens, and a combination of a plurality of lens (group lens) may also be used. In addition, the lens is not limited to a spherical type, and a non-spherical type may also be used.

In addition, the illumination device to which the present invention is applied is appropriately used for the above-mentioned vehicle lamp, and may be widely applied to other uses than the vehicle lamp.

REFERENCE SIGNS LIST

1A to 1H Illumination device
2, 2A, 2B, 2C, 2D Laser light source
3, 3A, 3B Wavelength conversion member
4, 4A, 4B, 4C, 4D Laser beam scanning mechanism
5 Reflector
6 Reflection plate
100 Vehicle lamp
200 Projection lens
BL Laser beam
YL Fluorescent light
WL Illumination light
E Laser beam irradiation region
O Center of laser beam irradiation region
S, S1, S2, S3, S4 Scanning range of laser beam
P, P1, P2, P3, P4 Center of scanning range of laser beam
Q, Q1, Q2, Q3, Q4 Center of laser beam scanning mechanism
VL, VL1, VL2, VL3, VL4 Vertical line
HL Horizontal line

The invention claimed is:

1. An illumination device comprising:

a laser light source configured to emit a laser beam;

a wavelength conversion member that includes a laser beam irradiation region to which the laser beam is radiated and that is configured to emit a wavelength converted light excited by radiation of the laser beam;

a laser beam scanning mechanism configured to form a light distribution pattern according to a scanning range of the laser beam by scanning the laser beam radiated to the laser beam irradiation region; and a projection lens configured to project illumination light that forms the light distribution pattern forward, wherein an incidence angle of the laser beam, which is scanned by the laser beam scanning mechanism, with respect to the wavelength conversion member is set to an angle where the laser beam does not directly enter the projection lens when the wavelength conversion member is damaged, chipped or fallen off, and the laser light source and the laser beam scanning mechanism are located at a position corresponding to at least one of an upper side and a lower side of the light distribution pattern with respect to the wavelength conversion member, and are disposed to be deviated to either one of one side corresponding to a left side of the light distribution pattern and other side corresponding to a right side of the light distribution pattern.

2. The illumination device according to claim 1, wherein, when the wavelength conversion member is seen in a plan view, a center of the scanning range of the laser beam is located at an intersection between a vertical line corresponding to an upward/downward direction of the light distribution pattern passing through a center of the laser beam scanning mechanism and a horizontal line corresponding to a leftward/rightward direction of the light distribution pattern passing through a center of the laser beam irradiation region.

3. The illumination device according to claim 1, wherein the laser light source and the laser beam scanning mechanism are disposed to be deviated on one side corresponding to the left side of the light distribution pattern and other side corresponding to the right side of the light distribution pattern, respectively, the laser beam scanning mechanism disposed on the one side forms a light distribution pattern according to a scanning range of one laser beam by scanning the one laser beam radiated toward the laser beam irradiation region from the laser light source disposed on the one side, the laser beam scanning mechanism disposed on the other side forms a light distribution pattern according to a scanning range of other laser beam by scanning the other laser beam radiated toward the laser beam irradiation region from the laser light source disposed on the other side, and one synthesis light distribution pattern is formed by overlapping the light distribution pattern according to the scanning range of the one laser beam and the light distribution pattern according to the scanning range of the other laser beam.

4. The illumination device according to claim 3, wherein, when the wavelength conversion member is seen in a plan view, each of the center of the scanning range of the one laser beam and the center of the scanning range of the other laser beam is located at intersections between the vertical lines corresponding to the upward/downward direction of the light distribution patterns passing through the centers of the laser beam scanning mechanisms and the horizontal lines corresponding to the leftward/rightward direction of the light distribution patterns passing through the centers of the laser beam irradiation regions, respectively.

5. The illumination device according to claim 1, wherein the laser light source and the laser beam scanning mechanism are additionally disposed at positions corresponding to an upper side or a lower side of the light distribution pattern with respect to the wavelength conversion member, or disposed at positions corresponding an upper side and a lower side of the light distribution pattern with respect to the wavelength conversion member, and at between the one side and the other side, the laser beam scanning mechanism disposed on an additional side forms a light distribution pattern according to a scanning range of an added laser beam radiated toward the laser beam irradiation region from the laser light source disposed on the additional side by scanning an additional laser beam, and one synthesis light distribution pattern is formed by overlapping the light distribution pattern according to the scanning range of the one laser beam, the light distribution pattern according to the scanning range of the other laser beam, and the light distribution pattern according to the scanning range of the added laser beam.

6. The illumination device according to claim 5, wherein, when the wavelength conversion member is seen in a plan view, a center of a scanning range of the added laser beam is located at an intersection between a vertical line corresponding to the upward/downward direction of the light distribution pattern passing through a center of the laser beam scanning mechanism on the additional side and a horizontal line corresponding to the leftward/rightward direction of the light distribution pattern which passes through the center of the laser beam irradiation region.

7. The illumination device according to claim 1, wherein the laser light source and the laser beam scanning mechanism are additionally disposed on the left side or the right side of the light distribution pattern with respect to the wavelength conversion member, or disposed at positions corresponding to the left side and the right side of the light distribution pattern with respect to the wavelength conversion member, the laser beam scanning mechanism disposed on an additional side forms a light distribution pattern according to a scanning range of an added laser beam radiated toward the laser beam irradiation region from the laser light source disposed on the additional side by scanning the added laser beam, and one synthesis light distribution pattern is formed by overlapping the light distribution pattern according to the scanning range of the one laser beam, the light distribution pattern according to the scanning range of the other laser beam, and the light distribution pattern according to the scanning range of the added laser beam.

8. The illumination device according to claim 7, wherein, when the wavelength conversion member is seen in a plan view, the center of the scanning range of the added laser beam is located at a side opposite to a side in which the laser beam scanning mechanism disposed on the additional side is disposed with respect to the center of the laser beam irradiation region.

9. The illumination device according to claim 1, wherein, when the wavelength conversion member is seen in a plan view, a width of the laser beam irradiation region, which corresponds to a leftward/rightward direction of the light distribution pattern, is greater than a height of the laser beam irradiation region, which corresponds to an upward/downward direction of the light distribution pattern.

10. A vehicle lamp comprising the illumination device according to claim 1.

* * * * *